US011679844B2

(12) United States Patent
Liu et al.

(10) Patent No.: US 11,679,844 B2
(45) Date of Patent: Jun. 20, 2023

(54) MOORING SUPPORT STRUCTURES, SYSTEMS FOR MOORING VESSELS, AND PROCESSES FOR USING SAME

(71) Applicant: SOFEC, INC., Houston, TX (US)

(72) Inventors: Yonghui Liu, Houston, TX (US); Stephen Lindblade, Waller, TX (US)

(73) Assignee: SOFEC, INC., Houston, TX (US)

( * ) Notice: Subject to any disclaimer, the term of this patent is extended or adjusted under 35 U.S.C. 154(b) by 83 days.

(21) Appl. No.: 17/091,533

(22) Filed: Nov. 6, 2020

(65) Prior Publication Data

US 2021/0139109 A1 May 13, 2021

Related U.S. Application Data

(60) Provisional application No. 62/932,860, filed on Nov. 8, 2019.

(51) Int. Cl.
*B63B 21/50* (2006.01)
*B63B 21/00* (2006.01)

(52) U.S. Cl.
CPC ..... *B63B 21/507* (2013.01); *B63B 2021/002* (2013.01); *B63B 2021/004* (2013.01); *B63B 2021/501* (2013.01)

(58) Field of Classification Search
CPC ..... B63B 21/507; B63B 2021/002; B63B 2021/004; B63B 2021/501; B63B 2035/448; B63B 27/24; B63B 27/34; B67D 9/02
See application file for complete search history.

(56) References Cited

U.S. PATENT DOCUMENTS

| | | | |
|---|---|---|---|
| 4,088,089 | A | 5/1978 | Flory |
| 4,114,556 | A | 9/1978 | Orndorff, Jr. et al. |
| 4,119,051 | A | 10/1978 | Orndorff, Jr. |
| 4,191,256 | A | 3/1980 | Croy et al. |
| 4,516,942 | A | 5/1985 | Pedersen |
| 4,568,295 | A | 2/1986 | Poldervaart |

(Continued)

FOREIGN PATENT DOCUMENTS

| | | |
|---|---|---|
| EP | 0298559 | 1/1989 |
| EP | 0337531 | 7/1992 |

(Continued)

OTHER PUBLICATIONS

International Search Report and Written Opinion for International Application No. PCT/US2020/059408 dated Mar. 12, 2021.

(Continued)

*Primary Examiner* — Anthony D Wiest
(74) *Attorney, Agent, or Firm* — Edmonds & Cmaidalka, P.C.

(57) ABSTRACT

Mooring support structures, systems for mooring vessels, and processes for using same. In some embodiments, a system for mooring a vessel can include a mooring support structure than can include a post connected at a first end to a turntable disposed on a base structure. The post can extend out from the turntable and a yoke head connector can be connected to a second end of the post. A distal end of the yoke head connector can provide a disconnection location such that when a yoke head is disconnected from the yoke head connector, the yoke head can fall by gravity from the yoke head connector without contacting the mooring support structure.

23 Claims, 11 Drawing Sheets

(56) References Cited

U.S. PATENT DOCUMENTS

| | | | |
|---|---|---|---|
| 6,227,135 | B1 | 5/2001 | Pedersen |
| 6,923,225 | B2 | 8/2005 | Poldervaart et al. |
| 7,007,623 | B2 | 3/2006 | Boatman et al. |
| 8,104,417 | B1 | 1/2012 | Shivers, III et al. |
| 8,763,549 | B2 | 7/2014 | Liu et al. |
| 9,573,659 | B2 | 2/2017 | Liu et al. |
| 2001/0029879 | A1 | 10/2001 | Cottrell et al. |
| 2003/0226487 | A1 | 12/2003 | Boatman et al. |
| 2004/0094082 | A1 | 5/2004 | Boatman et al. |
| 2005/0106959 | A1 | 5/2005 | Storvoll et al. |
| 2010/0326667 | A1 | 12/2010 | Coppens |
| 2014/0014017 | A1 | 1/2014 | Balleraud et al. |
| 2014/0034137 | A1 | 2/2014 | Kelly et al. |
| 2017/0113762 | A1 | 4/2017 | Lindblade |

FOREIGN PATENT DOCUMENTS

| | | |
|---|---|---|
| EP | 1826116 | 8/2007 |
| EP | 2070812 | 6/2009 |
| EP | 2646725 | 10/2013 |
| WO | 03/076262 | 9/2003 |
| WO | 2006/065130 | 6/2006 |
| WO | 2012/123191 | 9/2012 |
| WO | 2015/055327 | 4/2015 |
| WO | 2015/126320 | 8/2015 |

OTHER PUBLICATIONS

Wellman Dynamics Machining and Assembly Inc. "The Most Reliable Locking Device BEAR-LOC." BEAR-LOC. York, PA. <http://www.wdmachining.com>, undated.

International Search Report and Written Opinion for International Application No. PCT/US2016/058149, dated Dec. 2, 2016.

International Search Report and Written Opinion for International Application No. PCT/US2020/026572 dated Jul. 20, 2020.

International Search Report and Written Opinion for International Application No. PCT/US2020/026586 dated Jul. 22, 2020.

Third-Party Observation from EPO for European Patent Application No. 16860549.1 mailed on Nov. 5, 2020.

"A challenging mating operation between VLCC class FPSO and soft yoke mooring system in extremely shallow water", conference paper, Texas, USA, publication date Apr.-May 2012.

International Search Report and Written Opinion for International Application No. PCT/US2020/046803 dated Nov. 30, 2020.

MOORING SUPPORT STRUCTURES, SYSTEMS FOR MOORING VESSELS, AND PROCESSES FOR USING SAME

CROSS-REFERENCE TO RELATED APPLICATION

This application claims priority to U.S. Provisional Patent Application No. 62/932,860, filed on Nov. 8, 2019, which is incorporated by reference herein.

BACKGROUND

Field

Embodiments described generally relate to offshore mooring systems. More particularly, such embodiments relate to mooring support structures, systems for mooring vessels, and processes for using same.

Description of the Related Art

In the drilling, production, and transportation of offshore oil and gas, mooring systems have been used to connect floating production, storage, and offloading (FPSO) vessels, floating storage and offloading (FSO) vessels, and other floating vessels to various tower structures in the sea. Some conventional mooring systems are permanent, meaning the connected vessel can be maintained on location even in 100-year survival environmental conditions. Other conventional mooring systems are disconnectable, allowing vessels to leave the field to avoid severe weather events and conditions such as harsh seas, typhoons, hurricanes and icebergs.

Tower mooring systems are a type of mooring solution. Conventional tower structures typically include a bearing system that allows one part to rotate around a fixed geostatic part. When moored to the rotating part of the tower structure with a mooring connection, the vessel can weathervane around the geostatic part of the tower structure. Typical mooring connections include a hawser system or other rope, chain or elongated connection. Another mooring connection has been a soft yoke wishbone type system or tower yoke mooring system, which includes a rigid steel frame that can be connected to the tower structure using a series of hinges and to the vessel with the help of a pendulum structure.

Conventional tower yoke mooring systems can be disconnected to avoid typhoons, hurricanes, icebergs, and other extremely dangerous conditions that may or may not have appropriate advance notice, but the process is extremely time consuming and requires complex systems and external intervention in very limited sea states. These significant disconnect and reconnect sequence times can result in more lost production time, injury, or worse. During heavy sea states, the disconnection and reconnection process can also be susceptible to contact between the yoke, vessel, and/or tower, causing damage.

There is a need, therefore, for improved mooring systems and processes for using same.

SUMMARY

Mooring support structures, systems for mooring vessels, and processes for using same are provided. In some embodiments, a mooring system can include a mooring support structure that can include a base structure; a turntable disposed on the base structure; and a post extending from and connected at a first end to the turntable and a second end extending out from the turntable. The turntable can be configured to at least partially rotate about the base structure. The post can include a yoke head connector disposed on a second end thereof. The system can also include a vessel support structure disposed on a vessel floating on a surface of a body of water. At least one extension arm can be suspended from the vessel support structure. A ballast tank can be connected to the at least one extension arm. The ballast tank can be configured to move back and forth below the vessel support structure. A yoke can extend from and be connected at a first end to the ballast tank. The yoke can include a yoke head disposed on a second end thereof. The yoke head can be disconnectedly engaged with the yoke head connector. A length of the post can be configured to provide a connection location between the yoke head and the yoke head connector such that when the yoke head is disconnected from the yoke head connector, the yoke head can fall from the yoke head connector toward the surface of the body of water without contacting the mooring support structure. The system can also include a first elongated support connected at a first end to the vessel support structure and connected at a second end to the yoke. The elongated support can be configured to support the yoke when the yoke head is disconnected from the yoke head connector.

In some embodiments a process for disconnecting a vessel floating on a surface of a body of water moored to a mooring support structure can include disconnecting a yoke head from a yoke head connector. The mooring support structure can include a base structure, a turntable disposed on the base structure, wherein the turntable at least partially rotates about the base structure, and a post extending from and connected at a first end to the turntable and a second end extending out from the turntable, wherein the post comprises the yoke head connector disposed on a second end thereof. The vessel can include a vessel support structure disposed on the vessel. At least one extension arm can be suspended from the vessel support structure. A ballast tank can be connected to the at least one extension arm. The ballast tank can be configured to move back and forth below the vessel support structure. A yoke can extend from and can be connected at a first end to the ballast tank. The yoke can include the yoke head disposed on a second end thereof. A first elongated support can be connected at a first end to the vessel support structure and connected at a second end to the yoke. A length of the post can provide a connection location between the yoke head and the yoke head connector such that when the yoke head is disconnected from the yoke head connector, the yoke head can fall from the yoke head connector toward the surface of the body of water without contacting the mooring support structure. The process can also include maneuvering the vessel away from the mooring support structure.

BRIEF DESCRIPTION OF THE DRAWINGS

The various aspects and advantages of the preferred embodiment of the present invention will become apparent to those skilled in the art upon an understanding of the following detailed description of the invention, read in light of the accompanying drawings which are made a part of this specification.

DETAILED DESCRIPTION

Figure 1:
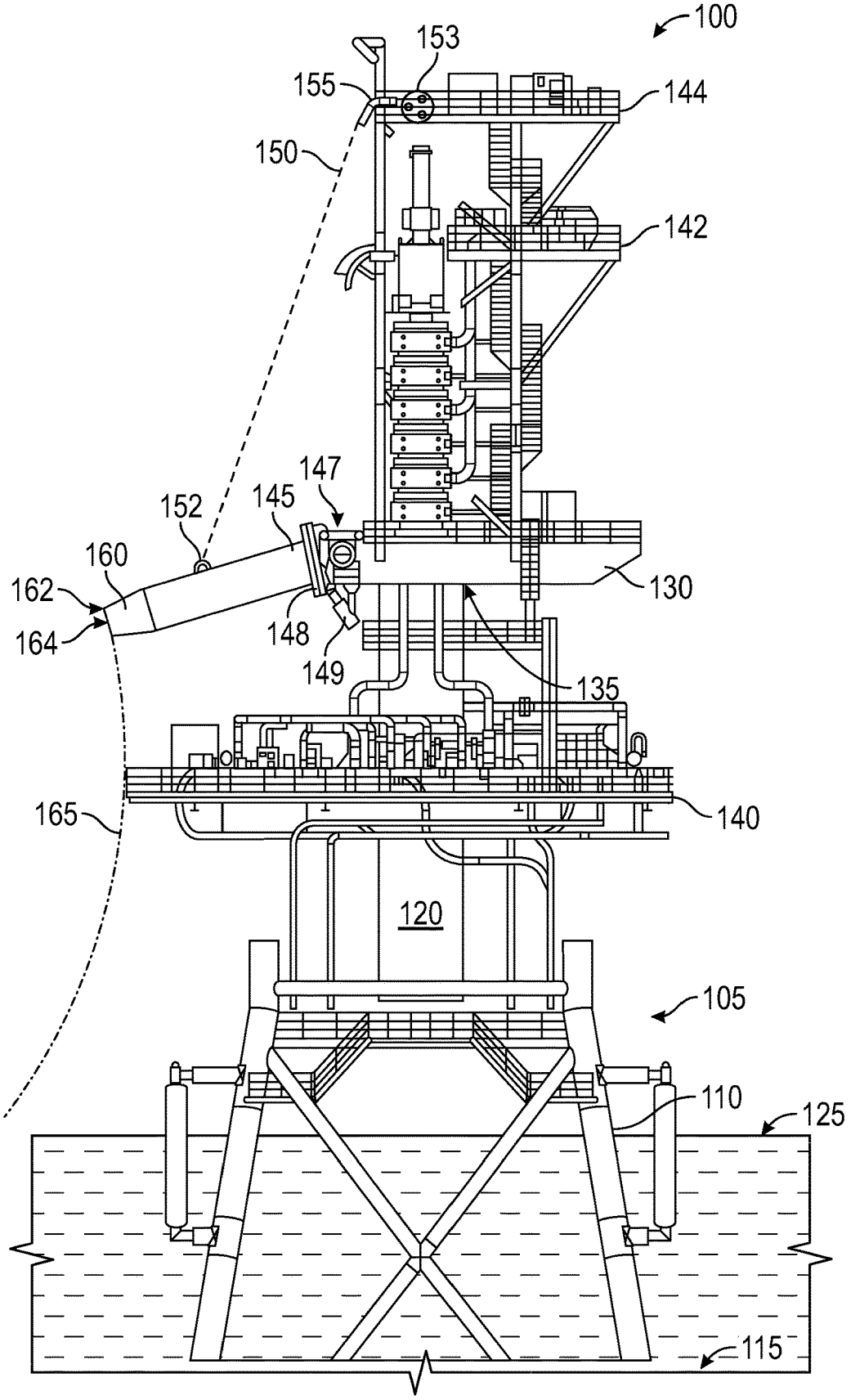
FIG. 1 depicts a schematic of an illustrative mooring support structure, according to one or more embodiments.

A detailed description will now be provided. Each of the appended claims defines a separate invention, which for infringement purposes is recognized as including equivalents to the various elements or limitations specified in the claims. Depending on the context, all references to the "invention", in some cases, refer to certain specific or preferred embodiments only. In other cases, references to the "invention" refer to subject matter recited in one or more, but not necessarily all, of the claims. It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows includes embodiments in which the first and second features are formed in direct contact and also includes embodiments in which additional features are formed interposing the first and second features, such that the first and second features are not in direct contact. The exemplary embodiments presented below may be combined in any combination of ways, i.e., any element from one exemplary embodiment may be used in any other exemplary embodiment, without departing from the scope of the disclosure. The figures are not necessarily drawn to scale and certain features and certain views of the figures can be shown exaggerated in scale or in schematic for clarity and/or conciseness.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Also, the naming convention used herein is not intended to distinguish between components that differ in name but not function. Furthermore, in the following discussion and in the claims, the terms "including" and "comprising" are used in an open-ended fashion, and thus should be interpreted to mean "including, but not limited to."

All numerical values in this disclosure are exact or approximate values ("about") unless otherwise specifically stated. Accordingly, various embodiments of the disclosure may deviate from the numbers, values, and ranges disclosed herein without departing from the intended scope.

Further, the term "or" is intended to encompass both exclusive and inclusive cases, i.e., "A or B" is intended to be synonymous with "at least one of A and B," unless otherwise expressly specified herein. The indefinite articles "a" and "an" refer to both singular forms (i.e., "one") and plural referents (i.e., one or more) unless the context clearly dictates otherwise. The terms "up" and "down"; "upward" and "downward"; "upper" and "lower"; "upwardly" and "downwardly"; "above" and "below"; and other like terms used herein refer to relative positions to one another and are not intended to denote a particular spatial orientation since the apparatus and methods of using the same may be equally effective at various angles or orientations.

FIG. 1 depicts a schematic of an illustrative mooring support structure 100, according to one or more embodiments. The mooring support structure 100 can be a raised tower or other structure 105 fixedly attached to the seafloor 115. The mooring support structure 100 can be a floating, anchored, or moored structure. The mooring support structure 100 can include a base or jacket structure 110. The base structure 110 can be fixedly attached to the seafloor 115 or connected to one or more pilings or piling foundations. The base structure 110 can be fixedly connected to a dock or other man-made structure, a coastal defense structure, land above sea-level, land below sea-level, and/or combinations thereof. The base structure 110 can also be floating, anchored, or moored. Coastal defense structures can be or can include, but are not limited to, a jetty, a groin, a seawall, a breakwater, or the like. In some embodiments, the base structure 110 can include a turntable 130 disposed thereon. The turntable 130 can be configured to at least partially rotate about the base structure 110.

In some embodiments, the base structure 110 can include a support column 120 disposed thereon. The support column 120 can include a plurality of decks (three are shown) 140, 142, 144 disposed about and/or on the support column 120 at various elevations above and/or below a water line 125.

The outer most portions of each deck 140, 142, 144 can define a keep out zone or perimeter about the column 120. The decks 140, 142, 144 can be arranged and designed to support various processing equipment, manifolds, etc. In some embodiments, the turntable 130 can be disposed on the support column 120. In some embodiments, the turntable 130 can include a bearing 135 to allow the turntable to freely weathervane about the mooring support structure 100. In other embodiments, the turntable 130 can be configured to or adapted to have a limited rotation travel about the column 120, for example, the rotational travel can be limited to less than plus or minus one-hundred and eighty degrees about the column 120. The rotational travel of the bearing 135 can be configured to or adapted to be limited to less than plus or minus ninety degrees, plus or minus forty-five degrees, plus or minus thirty degrees, plus or minus fifteen degrees, or any rotational travel limitations therebetween including eliminating all rotational travel about the turntable 130. To limit the rotational travel of the bearing 135, the bearing 135 can include mechanical stops, shock absorbers, springs, chains, cables, electric motors, hydraulic cylinders and/or combinations thereof. One or more decks, e.g., the decks 142, 144, can be located above the turntable 130 and the decks 142, 144 can rotate about the mooring support structure 100 with the turntable 130.

At least one post 145 can be connected at a first end to the turntable 130 and can extend out from the turntable 130. In some embodiments, the post 145 can be connected at the first end to a pitch bearing 147 that can be connected to the turntable 130 and can extend out from the pitch bearing 147. In some embodiments, the post 145 can be connected at the first end to a roll bearing 148 that can be connected to and extend from the turntable 130. In some embodiments, the pitch bearing 147 and the roll bearing 148 can be connected to each other and can be disposed between the post 145 and the turntable 130. The pitch bearing 147 and the roll bearing 148 can allow the post 145 to rotate about the pitch bearing 147 and/or the roll bearing 148. For example, the post 145 can be connected to the roll bearing 148 that can include a race with bearings to allow for rotational movement about and relative to a longitudinal axis defined between the first end and a second end of the post 145. The pitch bearing 147 can allow the post to rotate in an upward or downward direction with respect to the turntable 130. The post 145 can have any desired shape, e.g., a cylindrical shape, a cuboid shape, a triangular prism, or any other desired shape. The post 145 can be formed from one or more tubular members. Each tubular member can have a circular, squared, triangular, or other polygonal cross-sectional shape. The post 145 can be rigid and can have a fixed length. In some embodiments, the post 145 can be or can include two or more members. In some embodiments, the post 145 with the two or more members can be configured in a telescoping arrangement with respect to one another. As explained further below, the post 145 can be stored in a compact configuration and can telescope from the compact configuration to a fully extended length or vice versa.

A support member 150 can be attached to and extend from a mooring support structure anchor or anchor location 155 on the mooring support structure 100. The anchor location 155 can include a winch, hydraulic cushion cylinder, and/or other damping system 153 from which the support member 150 can be attached or extend. The anchor location 155 can be at an elevated position above the turntable 130. The anchor location 155 can rotate with the turntable 130 and the support member 150 can extend from the anchor location 155 and rotate with the turntable 130. The anchor location 155 can be a fixed post or other fixed structure and the support member 150 can connect thereto via a rotatable connection that can rotate about the fixed post. For example, the anchor location 155 can be a bearing disposed on or about a fixed post. The support member 150 can be connected to and extend from the bearing such that the support member 150 can rotate with the turntable 130 while the fixed post remains stationary. The anchor location 155 can be or can include an eyelet, a post, a bearing disposed on or about a fixed post or other structure, a grommet, an indentation, an aperture, a protrusion, or any other structure or combination of structures to which the support member 150 can attach. The support member 150 can be a rope, chain, wire, rigid rod, flexible rod, piston and rod, hydraulic cylinder, or any combination or one or more thereof. The length of the support member 150 can be varied such that an angle at which the post 145 extends from the turntable 130 can be varied or otherwise adjusted to any desired angle. The winch, hydraulic cushion cylinder, and/or other damping system 153 can vary the length of the support member 150 and thereby vary the angle at which the post 145 extends from the turntable 130. The length of the support member 150 can be from or between about one-hundred, seventy-five, sixty, fifty, forty, thirty, twenty, fifteen, ten, five, four, three, two, or one meters long. One or more hydraulic or pneumatic cylinders and/or arms 149 can be attached between the turntable 130 and/or pitch bearing 147 and the post 145 or roll bearing 148 to support the post 145 and/or vary or otherwise adjust the angle at which the post 145 extends from the turntable 130.

The support member 150 can be attached to the post 145 at a post anchor location 152. The post anchor location 152 can be located anywhere along the post 145. For example, the post anchor location 152 can be located proximal to the second end of the post 145. The post anchor location 152 can be located about half-way between the first end and the second end of the post 145. The post anchor location 152 can be located at a point measured from the second end of the post 145 toward the first end of the post 145 at about ninety-five, ninety, eighty, seventy-five, seventy, sixty-five, sixty, fifty-five, forty-five, forty, thirty-five, thirty, twenty-five, twenty, fifteen, ten, or five percent of the measured distance. The post anchor location 152 can be or can include an eyelet, a post, a grommet, an indentation, an aperture, a winch, a protrusion, or any other structure or combination of structures to which the support member 150 can attach. The support member 150 can be disposed at the post anchor location 152 about an outer perimeter of the post, e.g., in a looped configuration.

A yoke head connector 160 can be connected to the second end of the at least one post 145. In some embodiments, the at least one post 145 can be a first post and a second post. A first yoke head connector and a second yoke head connector can be connected to the second end of the first post and the second post, respectively. A surface 164 on the distal end of the yoke head connector 160 can be oriented perpendicular to a centerline defined through the center and along the length of the post 145. The surface 164 can be oriented at other angles. As described further below, the yoke head connector 160 can be configured to or adapted to cooperatively attach to a yoke head (215, shown in FIG. 2).

The length of the post 145, the yoke head connector 160, or the combination thereof can provide a disconnection location 162 at a distal end of the yoke head connector 160, between the mooring support structure 100 and a vessel 205 (see FIG. 2) such that during disconnection, the yoke head 215 can be separated from the yoke head connector 160 without contacting the mooring support structure 100. The disconnection location 162 at the distal end of the yoke head connector 160 can be provided such that during disconnection, the yoke head 215 can fall by gravity, for example along an arc 165, without contacting the mooring support structure 100. Although the fall direction is depicted as along the arc 165, the yoke head 215 can fall by gravity along any path. Said another way, the disconnection location 162 at the distal end of the yoke head connector 160 can be located such that when the yoke head 215 is disconnected from the yoke head connector 160, the yoke head 215 can fall, e.g., by gravity along the arc 165 or other path, from the yoke head connector 160 without contacting the mooring support structure 100. The disconnection location 162 can be outside the perimeter of any deck, for example deck 140, located below the post 145.

Figure 2:
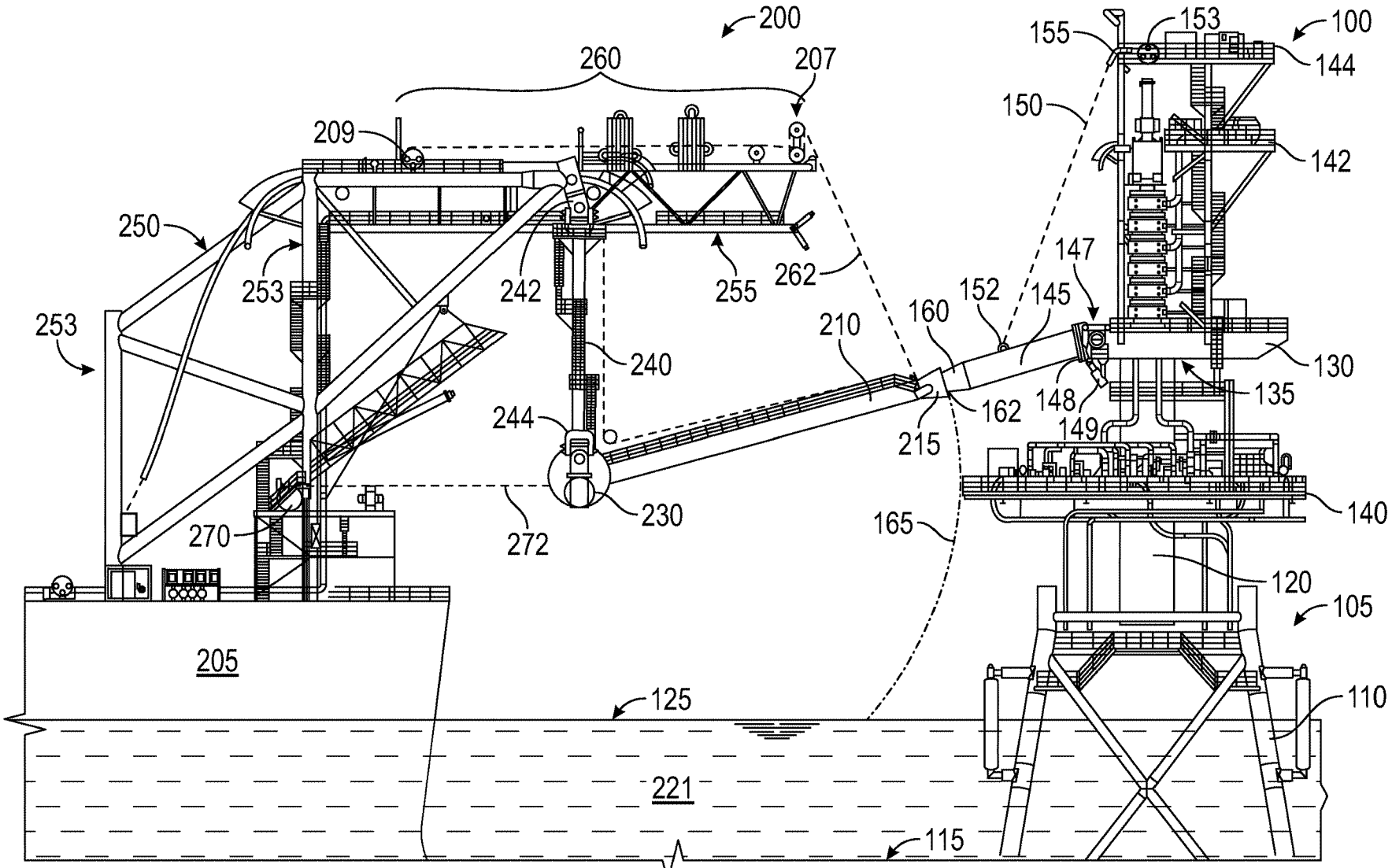
FIG. 2 depicts a schematic of the mooring support structure shown in FIG. 1 upon disconnection from a yoke mooring system disposed on a vessel, according to one or more embodiments.

FIG. 2 depicts a schematic of the mooring support structure 100 shown in FIG. 1 prior to disconnection from a yoke mooring system 200 disposed on a vessel 205, according to one or more embodiments. The yoke mooring system ("YMS") 200 can be located or otherwise disposed on the vessel 205. The yoke mooring system 200 can include a yoke 210, a yoke head 215, a ballast tank 230, and one or more link or extension arms 240 connected to a vessel support structure 250. The yoke mooring system 200 can also include a yoke lift and cushion system 260 and/or a first or ballast tank pull-back winch system 270. The yoke lift and cushion system 260 and the ballast tank pull-back winch system 270 can be electric, pneumatic, hydraulic, or a combination thereof. The ballast tank pull-back winch system 270 can also have motion compensation, including active heave compensation (AHC) and/or passive heave compensation (PHC). The ballast tank pull-back winch system 270 can use any combination of active heave compensation, passive heave compensation, and tension control to rapidly and accurately lift and/or pull-back the yoke 210 as needed in harsh offshore environments.

The yoke lift and cushion system 260 can be disposed on the vessel 205. In some embodiments, the yoke lift and cushion system 260 can be disposed on the vessel support structure 250 or one portion of the yoke lift and cushion system 260 can be disposed on the vessel 205 and a second portion can be disposed on the vessel support structure 250. The yoke lift and cushion system 260 can include one or more winches 209 (one is shown) and/or one or more cushion cylinders 207 (one is shown). The yoke lift and cushion system 260 can be connected proximal to the second end or distal end of the yoke 210. The connection between the yoke lift and cushion system 260 and the yoke 210 can be via one or more elongated supports or first elongated supports 262 (one is shown). The elongated support 262 can be any rope, cable, wire, chain, or the like, as well as any combinations of the same. The cushion cylinder 207 can be or can include one or more shock absorbers, one or more torsional springs, one or more wire line tensioners, one or more N-Line tensioners, one or more hydraulic and/or pneumatic cylinders with one or more oil and/or gas accumulators, and combinations thereof. In some embodiments, the cushion cylinder 207 can be or can include one or more shock absorbers and/or one or more passive heave compensators (PHC), such as those available from CRANEMASTER®. The elongated support 262 can be connected to the winch 209 at one end, routed over or around a portion of the cushion cylinder 207, and connected to the yoke 210 at the other end. The elongated support 262 can be routed over or around at least a portion of and connected at one end to the cushion cylinder 207 and connected at the other end to the yoke 210. One or more elongated supports 262 can be connected at one end to the winch 209 and at the other end to the yoke 210. One or more other elongated supports 262 can be connected at one end to the cushion cylinder 207 and at the other end to the yoke 210. The winch 209 and the cushion cylinder 207 can work separately or in combination to lift, lower, cushion, passively support, and/or otherwise control the yoke 210 during operations.

In some embodiments, the cushion cylinder 207 can be or can include a wire line tensioner. The wire line tensioner can be an accumulator loaded hydraulic/pneumatic cylinder. The wire line tensioner can include a pully system through which the elongated support 262 can be routed and/or attached to the wire line tensioner. A pre-defined tension can be applied to the yoke 210 through the elongated support 262 routed through the pulley system. The wire line tensioner can cushion the yoke 210 from the motions of the vessel 205, e.g., motions such as heave, roll, and/or pitch. The wire line tensioner can also act to slow, arrest, cushion, passively support, and/or otherwise control a fall of the yoke 210 during disconnection. In some embodiments, the cushion cylinder 207 can be or can include an N-Line tensioner where a piston within the N-Line tensioner can be connected directly to the yoke 210, or to the yoke 210 via the elongated support 262. A pulley system can also be included to route the elongated support 262 to the yoke 210. The piston can be cooperatively disposed within a cylinder within the N-Line tensioner. The cylinder can be connected to the vessel support structure 250. When the piston extends it can reduce the total fluid volume within an associated chamber and hence compress a fluid in the chamber that in turn increases the pressure acting upon the piston. Accordingly, the N-Line tensioner can slow, arrest, cushion, passively support, and/or otherwise control the fall of the yoke 210 during disconnection. The N-Line tensioner can also cushion the yoke 210 from the motions of the vessel 205, e.g., motions such as heave, roll, and/or pitch.

As shown in FIG. 2, the ballast tank 230 can be connected to the ballast tank pull-back winch system 270 via one or more elongated supports or second elongated supports 272 (one is shown). The elongated support 272 can be any rope, cable, wire, chain, rigid bar, or the like, as well as any combinations of the same. Accordingly, the yoke 210 and ballast tank 230 are able to freely move with respect to the vessel 205, and such movement can be limited, manipulated, or otherwise controlled by the yoke lift and cushion system 260 and the ballast tank pull-back winch system 270.

As explained in more detail below, the yoke lift and cushion system 260 and the ballast tank pull-back winch system 270 can be passive and/or can include constant tension control at the requisite tensions and loads to safely manipulate and control the movement of the yoke 210 and/or ballast tank 230 while connecting and/or disconnecting to the mooring support structure 100 using only the facilities located on the vessel 205 itself. The yoke lift and cushion system 260 and the ballast tank pull-back winch system 270 can be used independently, or together. The yoke lift and cushion system 260 and the ballast tank pull-back winch system 270 can each be or can each include a dedicated hydraulic power unit and any combination of one or more winches, controls, compensating cylinders, sheaves, accumulators and/or oil coolers. The one or more winches and one or more compensating cylinders can be used in parallel or in series. The one or more compensating cylinders can be vertical or horizontal. In certain embodiments, the one or more winches and the one or more compensating cylinders can be used in tandem (i.e., series) such that the compensating cylinders work at high speeds and low tension to gather the lines rapidly to control the back and forth and up and down movement of the yoke 210, ballast tank 230, or both. The winches can also be designed to handle higher tension requirements, such as during the initial lift and/or during ballast tank pull back for storage, for example.

In operation, the yoke lift and cushion system 260, for example, can be used to cushion movement of the yoke 210, including vertical movement of the yoke 210, while connecting to and/or disconnecting from the mooring support structure 100. For example, the yoke lift and cushion system 260 can be used to raise, lower and hold the yoke 210 in position as the vessel 205 is pushed or pulled to the mooring support structure 100 for connection and to support and lift the yoke 210 during disconnection from the mooring support structure 100. During disconnection, the yoke lift and cushion system 260 can control or cushion the movement of the yoke 210, allowing control of the yoke 210 via the cushion cylinder 207. Accordingly, active heave compensation can be eliminated from the yoke lift and cushion system 260 and the overall complexity of the associated components can be significantly simplified. For example, the winch 209 can be set to freely release the elongated support 262 such that the cushion cylinder 207 can be all that controls the elongated support 262. In this example, the cushion cylinder 207 can cushion or slow the rate of decent of the yoke 210 during disconnection rather than being required to have an ability to quickly arrest the decent so as to avoid contacting components of the mooring support structure 100 and/or to avoid damage to the yoke 210 and/or yoke head 215 due to it hitting the water line 125 at too high a speed.

The cushion cylinder 207 can limit the distance the yoke 210 can fall after disconnection by limiting the length of the elongated support 262 that can spool or otherwise extend from the yoke lift and cushion system 260. For example, before or after disconnection, the elongated support 262 can be disconnected from the winch 209 and attached to the cushion cylinder 207 or the winch 209 can be prevented from moving and the cushion cylinder 207 can react to any movement of the yoke 210, thereby limiting the amount of the elongated support 262 that can extend from the cushion cylinder 207 to the amount of elongated support 262 that may be routed through the cushion cylinder 207. The amount of elongated support 262 routed through the cushion cylinder 207 can be such that the yoke 210 can fall no more than about 1 meter, 2 meters, 3 meters to about 10 meters, 20 meters, 30 meters or more after disconnection, for example from the disconnection location 162 at the distal end of the yoke head connector 160, toward the water line 125. The length of the elongated support 262 can be chosen to prevent the yoke 210 or yoke head 215 from entering the water 221 or allow the yoke 210 or yoke head 215 to enter the water 221. The overall length of the yoke 210 and yoke head 215 along with a distance between the water line 125 and the ballast tank 230 can be selected to prevent the yoke 210 or the yoke head 215 from entering the water 221, regardless the length of the elongated support 262 extending from the cushion cylinder 207. The winch 209 can be allowed to freely release the elongated support 262 and the cushion cylinder 207 can cushion the motion of the yoke 210 while the yoke falls by gravity toward the water line 125. The winch 209 can be separately connected to the yoke 210 before or after the yoke 210 has been disconnected and the winch 209 can lift the yoke 210 up for stowage, sail away, and transport or for reconnection.

The ballast tank pull-back winch system 270 can be used to hold and control movement of the ballast tank 230, including the horizontal movement of the ballast tank 230, while connected, during disconnection, and during storage for transit. The ballast tank pull-back winch system 270 can be used to affect the yaw angle of the ballast tank 230 and the yoke 210. During disconnection, for example, the yoke lift and cushion system 260 and the ballast tank pull-back winch system 270 can be used together to lift, lower, pullback, hold, cushion, passively support, and/or otherwise control the yoke 210, preventing the yoke 210 from colliding with the mooring support structure 100 and causing physical damage to itself or the tower or both. The ballast tank pull-back winch system 270 could be used to manipulate and control movement of the ballast tank during disconnection and connection. In certain embodiments, the ballast tank pull-back winch system 270 is not used during connection or disconnection.

Still referring to FIG. 2, the yoke 210 can be any elongated structure with sufficient strength to connect the vessel 205 to an offshore structure. For example, the yoke 210 can be formed from one or more tubular members or legs (411, 412 shown in FIG. 4). Each tubular member can have a circular, squared, or other polygonal cross-sectional shape. In certain embodiments, the yoke 210 can have two legs arranged in a "V" shape in plan view that are connected to the ballast tank 230 at one end and connected to the yoke head 215 at the other end.

The yoke head 215 can be a conical coupler that can accept the yoke head connector 160 therein, as shown, therethrough, there around, or combinations thereof. The yoke head connector 160 can be a conical coupler that can accept the yoke head 215 there around, as shown, therein, therethrough, or combinations thereof. In other words, the yoke head 215 and the yoke head connector 160 can be complimentary connectors that can interact to form at least a mechanical connection therebetween. Both the yoke head 215 and the yoke head connector 160 can have conical or frusto-conical shaped surfaces: an inner or outer surface of the yoke head 215 (female or male) and an outer or inner surface of the yoke head connector 160 (male or female). These complementary conical surfaces can provide a sliding surface to facilitate and guide the connection between the yoke head 215 and the yoke head connector 160. An aperture can be formed in the yoke head 215 and can slide over portions of the yoke head connector 160 for connection between the yoke head 215 and the yoke head connector 160. An aperture can be formed in the yoke head connector 160 and can slide over portions of the yoke head 215 for connection therebetween. It should be understood that the yoke head 215 and the yoke head connector 160 can have any desired configuration with conical only being one example.

When connected, the ballast tank 230, extension arms 240 and yoke 210 can form a somewhat "L" shaped frame in elevation view. As explained in more detail below, the ballast tank 230, extension arms 240, and yoke 210 can provide a restoring force for mooring the vessel 205 to the mooring support structure 100.

The vessel support structure 250 can be a raised tower or other framed structure for supporting the yoke 210, the ballast tank 230, and the extension arms 240. The vessel support structure 250 can include a generally vertical section 253 and a generally horizontal section 255. The generally horizontal section 255 can be cantilevered over a side of the vessel 205 including the bow or the stern. The generally horizontal section 255 can extend beyond the side of the vessel 205 and can help support the weight of the ballast tank 230, extension arms 240, and yoke 210.

The ballast tank 230 can be any container, drum or the like capable of holding water, high density concrete blocks, or other ballast. The ballast tank 230 can be connected to the yoke 210 and/or the extension arm(s) 240. The ballast tank 230 can be connected to the vessel support structure 250 via the one or more extension arms 240. As such, the ballast tank 230 can be configured to or adapted to move back and forth and/or an up and down with respect to the vessel support structure 240. The ballast tank 230 can be configured to or adapted to move back and forth and/or an up and down below the vessel support structure 250. The ballast tank 230 can serve as a counterbalance or restoring force as the vessel 205 moves at sea.

The extension arms 240 can be connected to the vessel support structure 200 on the generally horizontal section 255 via one or more upper U-joints 242. The extension arms 240 can also be connected to the ballast tank 230 using one or more lower U-joints 244. The extension arms 240 can include one or more jointed sections that are mechanically connected together. The extension arms 240 can each be or include rigid pipe, conduit, rods, chains, wire, combinations thereof, or the like. The vessel support structure 250 via connection through the extension arms 240 can suspend the ballast tank 230. The U-joints 242, 244 are provided as one type of coupler that can be used, however, any type of coupling that permits angular movement between its connections can be equally employed.

By "vessel" it can be meant any type of floating structure including but not limited to tankers, boats, ships, FSO's, FPSO's and the like. It should be appreciated by those skilled in the art that the yoke mooring system 200 can be mounted or otherwise disposed on converted vessels as well as new-built vessels.

Figure 3:
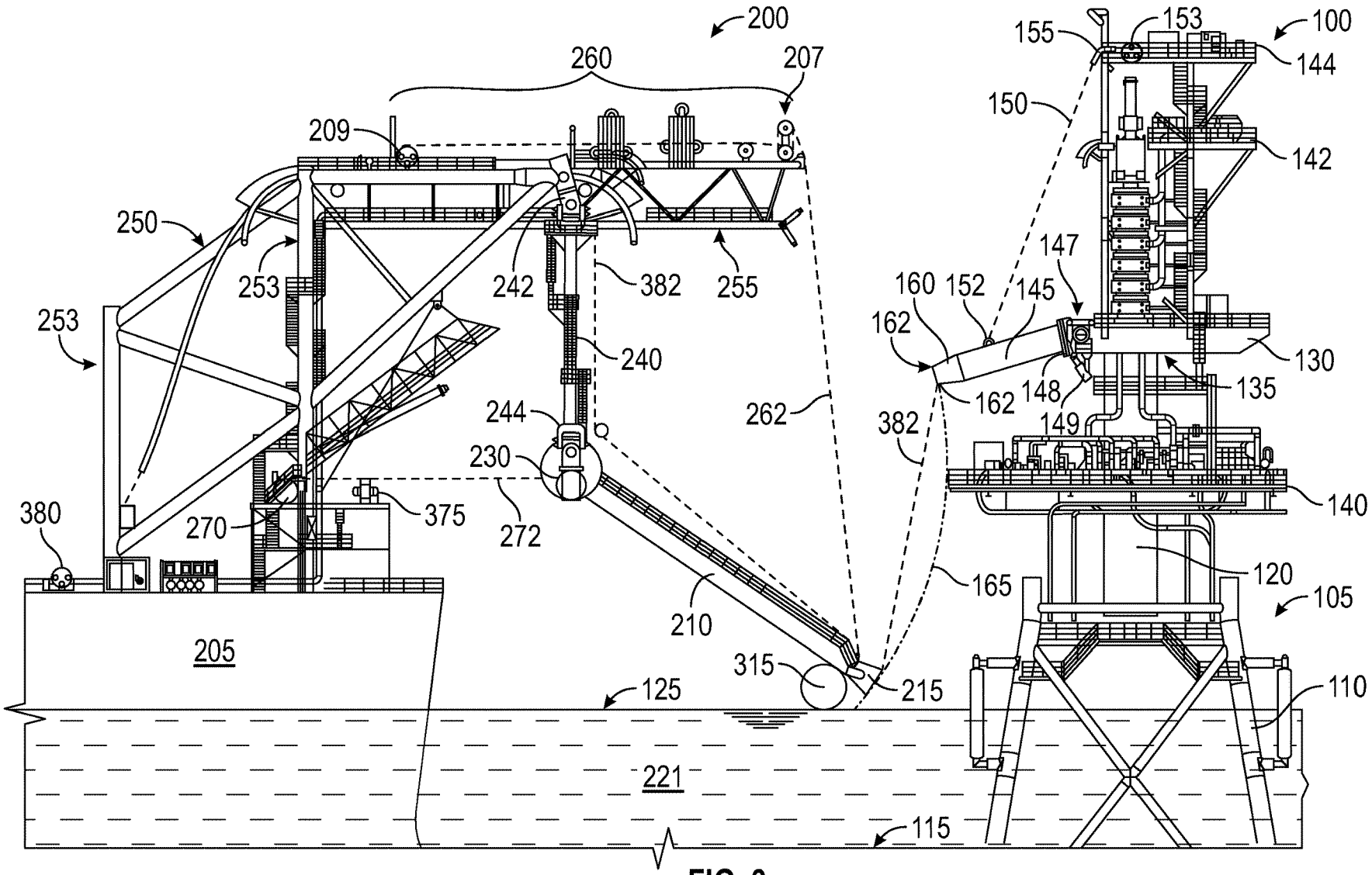
FIG. 3 depicts a schematic of the illustrative mooring support structure after a yoke has fallen away from a yoke head connector disposed on the mooring support structure and the yoke further includes a buoyancy tank, according to one or more embodiments.

FIG. 3 depicts a schematic of the illustrative mooring support structure 100 after the yoke 210 has fallen away from the yoke head connector 160 disposed on the mooring support structure 100 and the yoke 210 further includes a buoyancy tank 315, according to one or more embodiments. The vessel 205 may need to be disconnected from the mooring support structure 100 for various reasons, for example due to completion or cessation of operations or excessive environmental condition causing safety concerns. In some embodiments, to disconnect the vessel 205 from the mooring support structure 100, the propulsion system/engines of the vessel 205 can be engaged, such as using a stern thrust, prior to or after the disconnection of the yoke head 215. The thrust can be supplied by the propulsion system/engines, or by using one or more external interventions, either exclusively or in combination with the propulsion system engines of the vessel, such as by one or more tugs, boats, ships or other vessel(s). The thrust can create a tension away from the mooring support structure 100 and should be sufficient to overcome any current or wave forces acting on the vessel 205. One or more hoses or flow lines and/or cables can be disconnected before or after the vessel thrust is applied. In other embodiments, to disconnect the vessel 205 from the mooring support structure 100, the propulsion system/engines of the vessel 205 can be disengaged, such that no thrust is produced during disconnection of the yoke head 215 from the yoke head connector 160. As such, in some embodiments, the vessel 205 and/or external intervention can be configured to not apply any thrust to urge the vessel away from the mooring support structure 100 when the yoke head 215 is disconnected from the yoke head connector 160. In other embodiments, the vessel 205 and/or external intervention can be configured to apply thrust to urge the vessel away from the mooring support structure 100 when the yoke head 215 is disconnected from the yoke head connector 160.

With the thrust applied to urge the vessel 205 away from the mooring support structure 100 before or after the yoke head 215 is disconnected from the yoke head connector 160, the vessel 205 can move away from the mooring support structure 100. The motion away from the mooring support structure 100 can separate the yoke head 215 from the yoke head connector 160. As explained further below, the yoke head 215 can fall away from the yoke head connector 160 without reversing the trust. In these embodiments, the yoke head 215 can fall away from the yoke head connector 160 without contacting the mooring support structure 100. The cushion cylinder 207 can control the movement of the yoke 210 without the need for active control systems. Optionally, a buoyancy tank 315 can be connected to the yoke 210 proximate the distal end of the yoke 210 and/or yoke head 215 to support floating at least a portion of the yoke 210 and/or yoke head 215, should the yoke 210 or the yoke head 215 and a portion of the yoke 210 enter the water 221. The buoyancy tank 315 could be connected and sized in a such a way as to prevent the yoke 210 and/or yoke head 215 from entering the water 221.

Back and forth movement (or horizontal movement) of the ballast tank 130 and hence the yoke head 215 can be reduced or dampened using the capabilities of the ballast tank pull-back winch system 270 during the disconnection operation. Side to side movement of the ballast tank 230 can be further reduced or dampened using the capabilities of a spring line winch system 375. Working in combination with the yoke lift and cushion system 260, which can be located above the yoke 210, the ballast tank pull-back winch system 270 located laterally or near lateral to the ballast tank 230, and optionally in combination with the spring line winch system 375, the example combinations can effectively and reliably control the yoke 210, which can significantly reduce the risk of banging or otherwise contacting the yoke 210 and/or yoke head 215 with the mooring support structure 200 or the vessel 205. Applying the thrust to urge the vessel 205 away from the mooring support structure 100 before or after the yoke head 215 is disconnected from the yoke head connector 160 can also reduce the risk of banging or otherwise contacting the yoke 210 and/or yoke head 215 with the mooring support structure 200 or the vessel 205. This operation can be particularly useful in relatively harsh conditions, which presents a real danger of collision between the vessel 205 and the mooring support structure 100, and/or the yoke 210 or yoke head 215 and the mooring support structure 100.

Still referring to FIG. 3, in some embodiments a second winch system or pull-in winch system 380 can be utilized to facilitate connection between the yoke head 215 and the yoke head connector 160. The pull-in winch system 380 can pull the vessel 205 toward the mooring support structure 100 by providing a pull-in line 382 from the pull-in winch system 380 through the yoke 210 to the mooring support structure 100. The pull-in winch system 380 and the pull-in line 382 can provide guidance for the structural connection of the yoke 210 to the mooring support structure 100. After the yoke head 215 and yoke head connector 160 are connected, the pull-in line 382 can be disconnected from the mooring support structure 100 and stowed on or along the yoke 210 or elsewhere on the yoke mooring system 200. Accordingly, the pull-in line 382 can be, but does not need to be, disposed between the yoke head 215 and the yoke head connector 160 before and/or after disconnection. The pull-in line 382 can be any rope, cable, chain, wire or the like, as well as any combinations of the same. Similar to the winch systems 270, the pull-in winch system 380 can be or can include a dedicated hydraulic power unit and any combination of one or more winches, controls, compensating cylinders, sheaves, accumulators and/or oil coolers to provide rapid and reliable response times.

Figure 4:
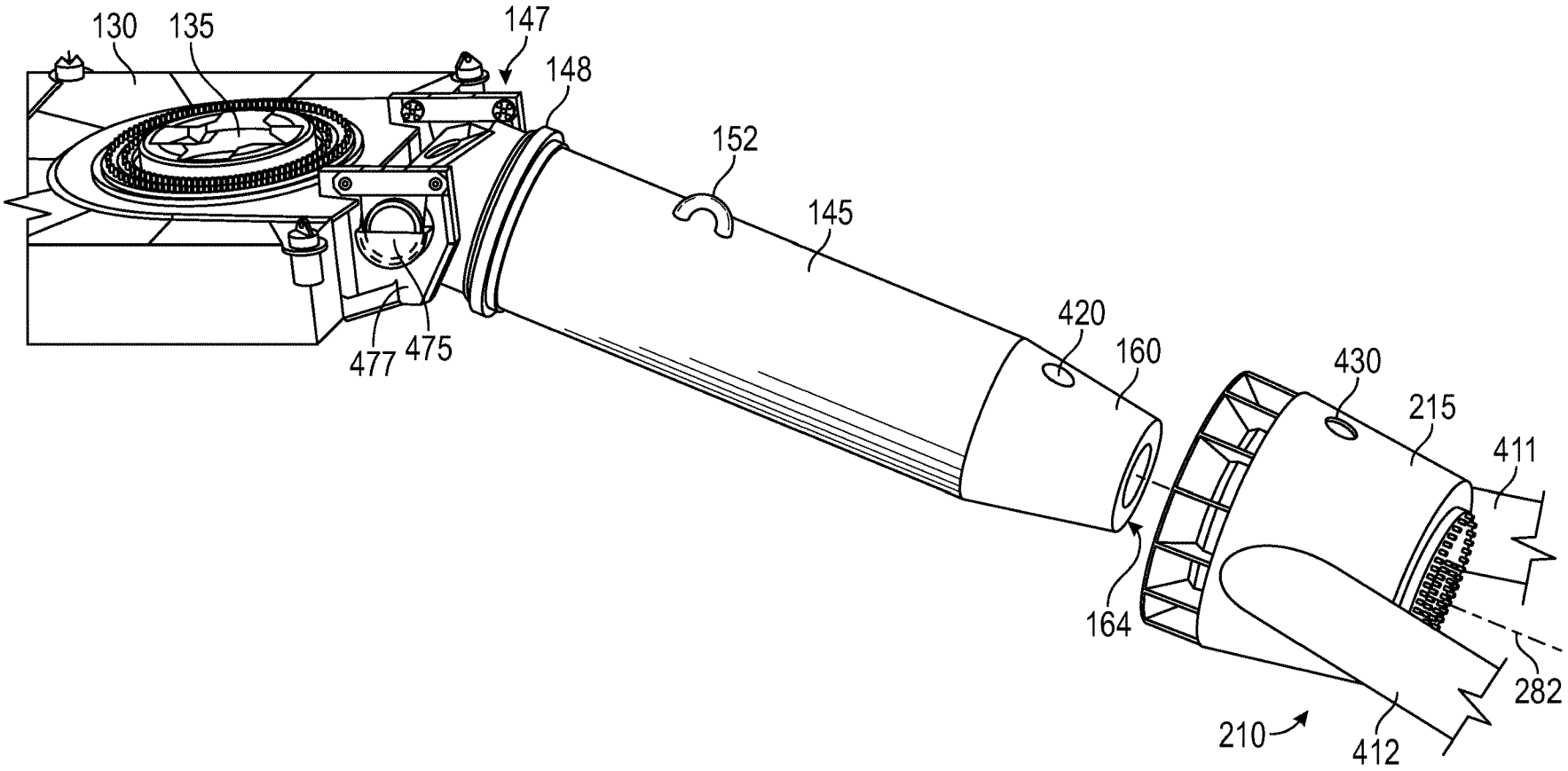
FIG. 4 depicts an enlarged perspective view of a yoke head connector shown in FIG. 3 prior to connection to or after disconnection from the yoke head, according to one or more embodiments.

FIG. 4 depicts an enlarged perspective view of the yoke head connector 160 shown in FIG. 3 prior to connection to or after disconnection from the yoke head 215, according to one or more embodiments. The yoke head connector 160 can be connected to the post 145 and the post 145 can be connected to the pitch bearing 147 that can include one or more joints or connectors that allow for pivotal movement relative to the turntable 130. The pitch bearing 147 can include a trunnion mounted connector 475 that can extend outwardly from a trunnion housing 477. The post 145 can be connected to or include the trunnion mounted connector 475. The one or more hydraulic or pneumatic cylinders and/or arms 149 can help move the post 145 and yoke head connector 160 to facilitate the connection with the yoke head 215. The legs 411, 412 can be connected to the yoke head 215. The connections can be achieved by welding, bolting, forming, machining, forging, sand casting, and the like, or combinations thereof.

To facilitate this connection, the yoke head connector 160 can be a receptacle that can receive the yoke head 215. One or more apertures 420 (one is shown) can be formed through at least a portion of the yoke head connector 160 and one or more apertures 430 (one is shown) can be formed through at least a portion of the yoke head 215. When the yoke head connector 160 and the yoke head 215 are brought together, the apertures 420, 430 can be aligned such that a shaft or mechanical lock (510 shown in FIG. 5) can be inserted through the apertures 420, 430 to mechanically connect the yoke head connector 160 and the yoke head 215. Suitable mechanical locks can be or can include an interference sleeve lock, such as for example, the BEAR-LOC®. locking device, manufactured by Wellman Dynamics Machining and Assembly Inc. of York, Pa.

Figure 5:
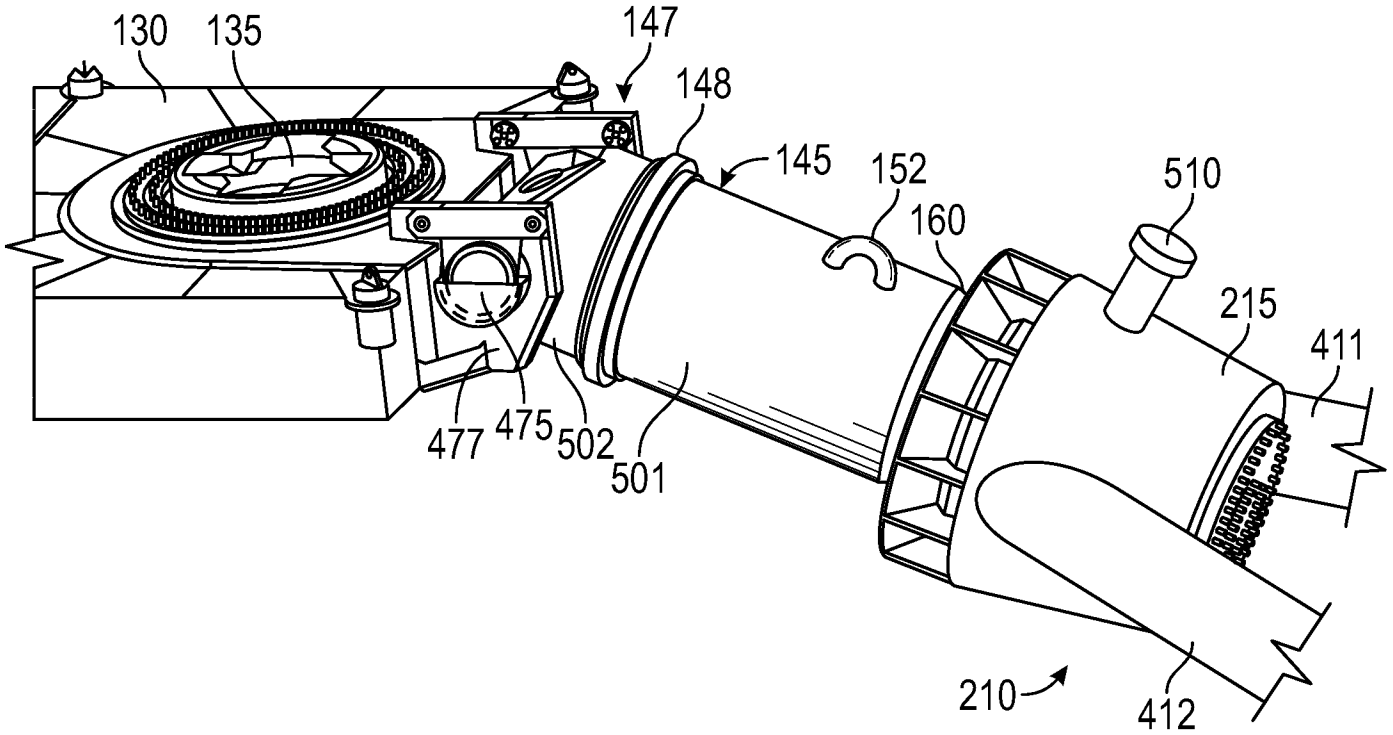
FIG. 5 depicts an enlarged perspective view of another illustrative yoke head and yoke head connector after being connected to one another, according to one or more embodiments.

FIG. 5 depicts an enlarged perspective view of another illustrative yoke head 215 and yoke head connector 160 after being connected to one another, according to one or more embodiments. As noted above, the post 145 can be solid, as depicted with reference to FIG. 4, or can include two or more interconnecting tubular members 501,502 (two are shown) as depicted with reference to FIG. 5. The interconnecting tubular member 501 can telescope inwardly, over or inside of tubular member 502, toward the turntable 130 into a collapsed configuration, as depicted in FIG. 5, and subsequently telescope out to the full length of the post 145.

The collapsed configuration for post 145 can be maintained through the use of mechanical pins, hydraulics, pneumatics, or combinations thereof. The telescoping of the post 145 can provide the post 145 with a variable length. The variable length of post 145 can allow the vessel 205 to be brought closer to the mooring support structure 100 during operations. During disconnection operations, the post 145 can telescope out to its full length allowing for disconnection without the risk of the yoke head 215 contacting the mooring support structure 100.

The telescoping action and the extended configuration for post 145 can be controlled and maintained in various ways. For example, a mechanical, hydraulic, and/or pneumatic mechanism such as a brake or mechanical lock, can be incorporated into the post 145 to hold the post 145 at one or more lengths. In some embodiments, the post 145 can be a hydraulic piston and cylinder capable of extending and retracting. As such, a length of the post 145 can be adjustable such that during connection and/or disconnection of the yoke head 215 and the yoke head connector 160 the connection location can be at a first location and after connection and/or disconnection of the yoke head 215 and the yoke head connector 160 the connection location can be at a second location, where the second location can be closer to the mooring support structure 100 than the first location. In some embodiments, the distance between the first location and the second location can be about 0.5 m, about 1 m, about 1.5 m, about 2 m, about 2.5 m, or about 3 m to about 3.5 m, about 4 m, about 4.5 m, about 5 m, or more. In some embodiments, the extended configuration for post 145 can be maintained through the use of stern thrust from the vessel 205 prior to disconnection from the mooring support structure 100 and during the disconnection process.

Figure 6:
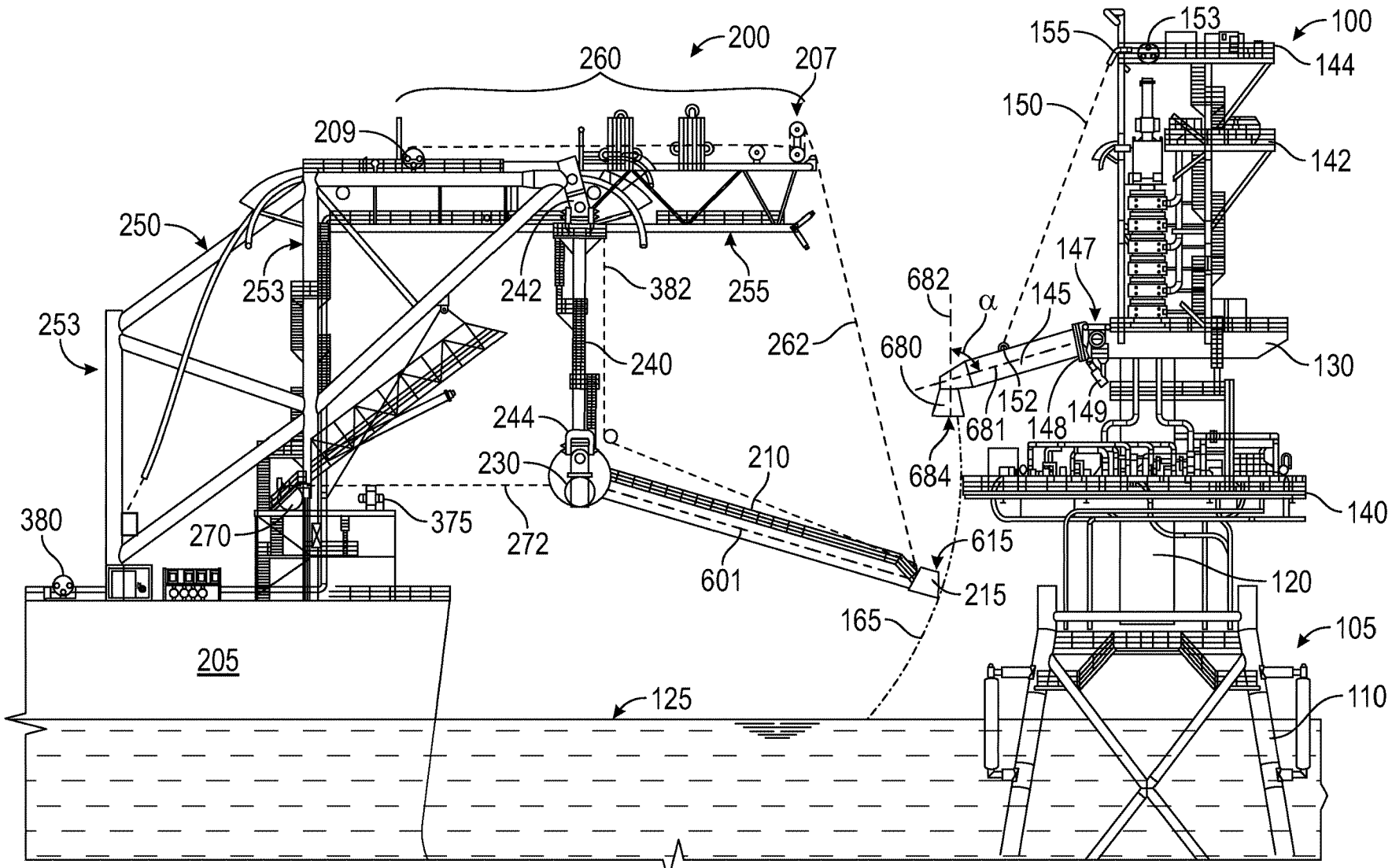
FIG. 6 depicts a schematic of an illustrative mooring support structure having an angled yoke head connector, according to one or more embodiments.

FIG. 6 depicts a schematic of an illustrative mooring support structure 100 having an angled yoke head connector 680, according to one or more embodiments. The angled yoke head connector 680 can be or can include a conical coupler that can accept the yoke head 215 there around, therein, as shown, therethrough, or combinations thereof. A surface 684 formed across at least a portion of a distal end of the angled yoke head connector 680 can be oriented at an angle $\alpha$ not perpendicular to a centerline 681 defined through the center and along the length of the post 145, in a downward direction, or otherwise toward, but not necessarily parallel to, the water line 125. A longitudinal centerline 682 through the angled yoke head connector 680 can be oriented at the angle $\alpha$, not colinear with the longitudinal centerline 681 of the post 145, in a downward direction, or otherwise toward, but not necessarily perpendicular to, the water line 125. The longitudinal centerline 682 through the angled yoke head connector 680 can be oriented at an angle not colinear with the longitudinal centerline 681 of the post 145 and the longitudinal centerline 682 extending from a distal end of the yoke head connector 680 can be oriented in a downward direction.

An aperture 615 can be formed within the yoke head 215 for accepting at least a portion of the angled yoke head connector 680. The aperture 615 can be oriented upward at an angle greater than zero degrees to a center line 601 along the length of the yoke 210 to align the aperture 615 with the angled yoke head connector 680 for connection. The angled yoke head connector 680 can have conical or frusto-conical shaped surfaces: an outer or inner surface of the angled yoke head connector 680 (male or female). These conical surfaces can provide a sliding surface to facilitate and guide the connection between the yoke head 215 and the angled yoke head connector 680. It should be understood that the yoke head 215 and the yoke head connector 680 can have any desired configuration with conical only being one example.

Figure 7:
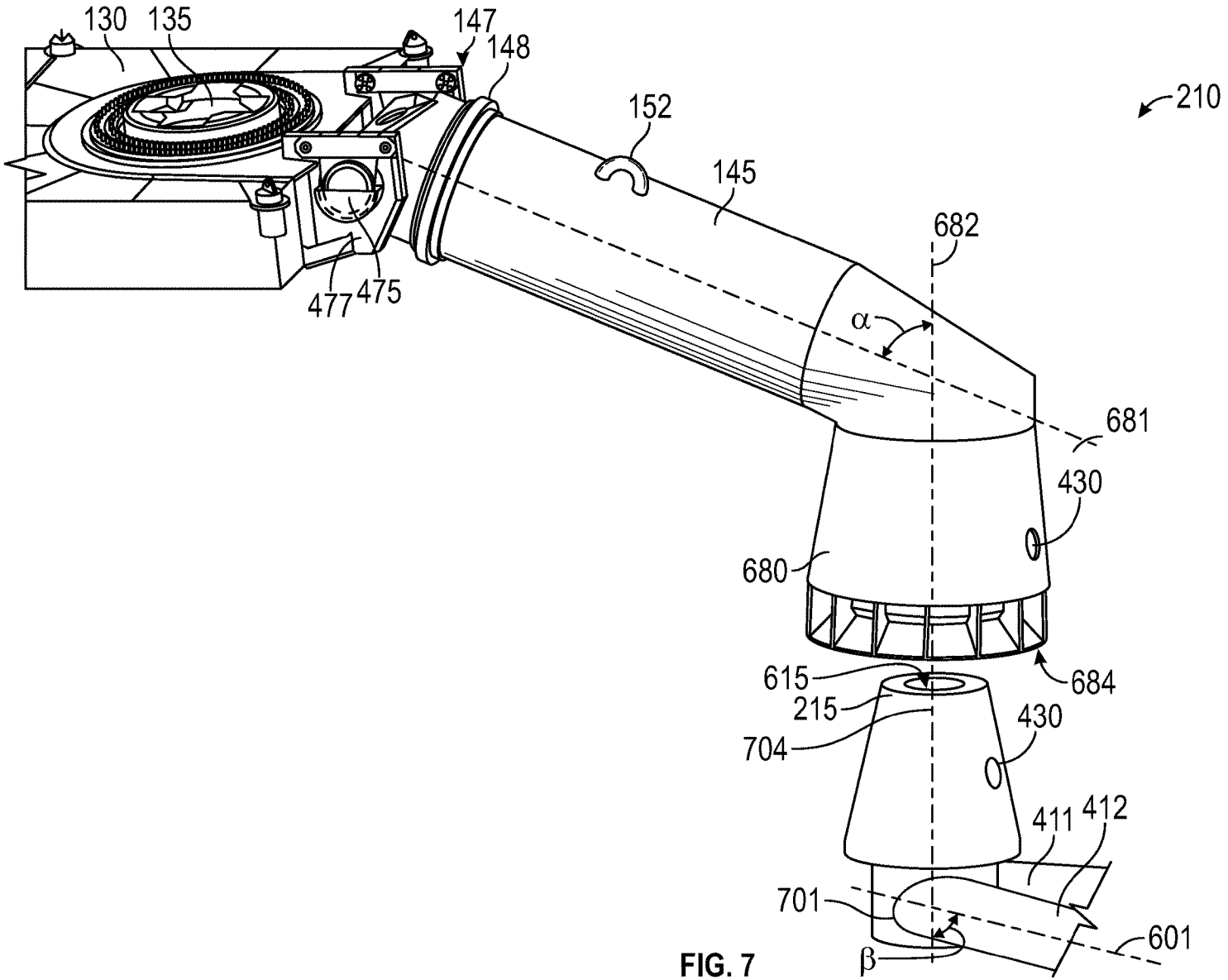
FIG. 7 depicts an illustrative schematic depicting an enlarged perspective view of the angled yoke head connector shown in FIG. 6 after disconnection from or before connection to the yoke head, according to one or more embodiments.

FIG. 7 depicts an illustrative schematic depicting an enlarged perspective view of the angled yoke head connector 680 shown in FIG. 6 after disconnection from or before connection to the yoke head 215, according to one or more embodiments. The downward orientation of the angled yoke head connector 680 can be fixed during fabrication. The downward orientation of the angled yoke head connector 680 can be selected and set prior to connection with the yoke head 215. For example, the connection between the post 145 and the angled yoke head connector 680 can be or can include a bearing that can be rotated and then locked at a particular angle. The bearing can allow the angled yoke head connector 680 to rotate around the distal end of the post 145. Once the desired orientation is achieved, the orientation can be fixed by securing the bearing so that it can no longer rotate. The angled yoke head connector 680 can be connected to the post 145 via a ball joint, one or more eyelets, one or more bearings, or combinations thereof, such that the desired orientation can be selected in the field and secured. It should be readily appreciated by those skilled in the art that there are many other ways to connect the angled yoke head connector 680 to the post 145 without going outside the scope of the embodiments herein.

The angle β between a centerline 704 of the aperture 615 and a centerline 601 of the leg 412 can be selected and fixedly set during fabrication. For example, the legs 411, 412 can be secured at a connection location 701, by welding, bolting, or other connection means, such that the angle β is set during the yoke 210 fabrication process. The angle β can be selected in the field and set prior to connection with the angled yoke head connector 680. For example, the connection location 701 can be or can include a bearing connected between the yoke head 215 and the legs 411, 412, that can be rotated and then locked at a particular angle. The bearing can allow the yoke head 215 to rotate about the connection location 701 to select the angle β. Once the angle β is achieved, the angle β can be fixed by securing the bearing so that it can no longer rotate. Connection and disconnection between the yoke head 215 and the angled yoke head connector 680 can be achieved as describe herein, with reference at least to FIG. 5 and/or FIGS. 10 and 11.

Figure 8:
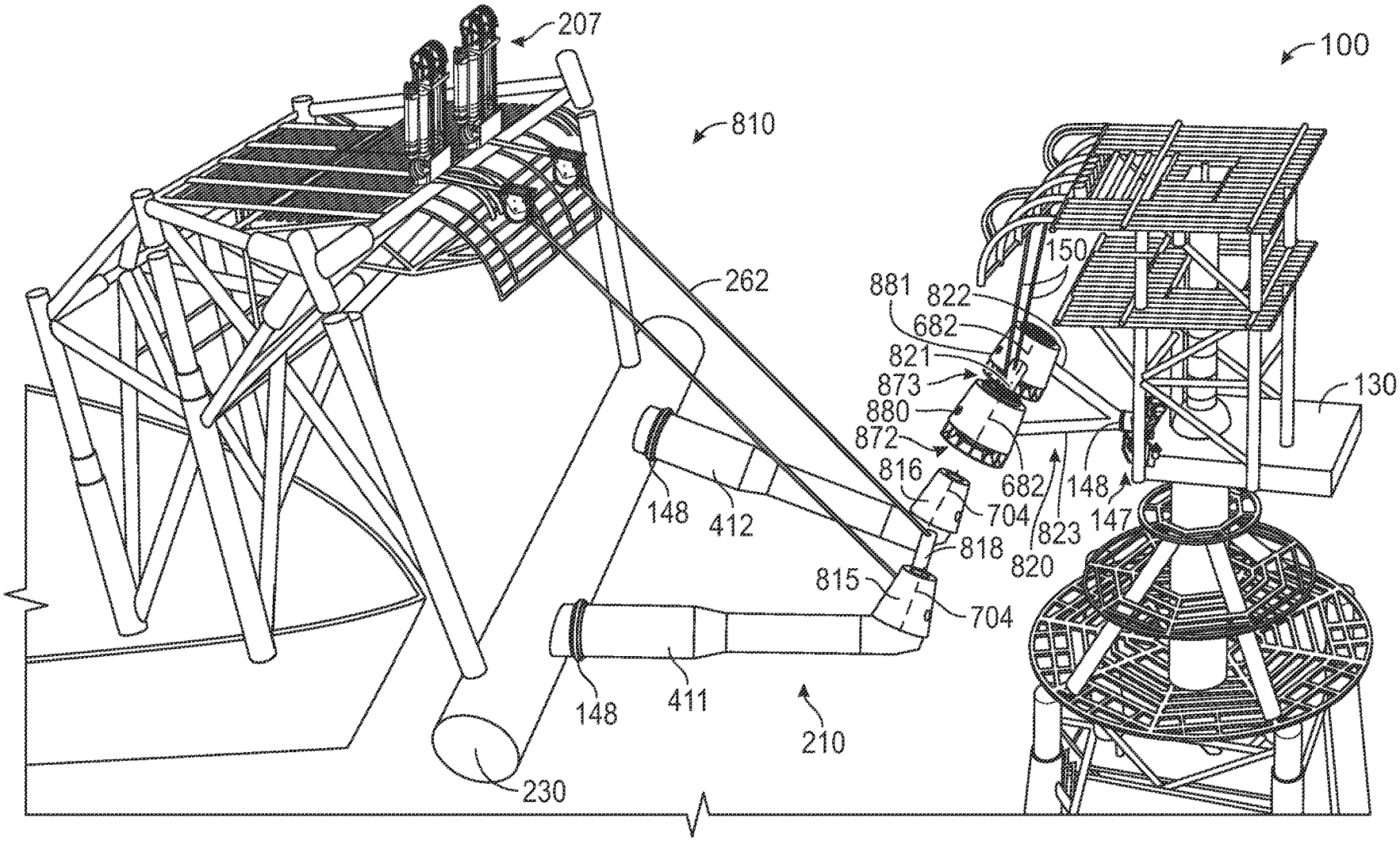
FIG. 8 depicts a schematic of an illustrative mooring support structure having multi-yoke head connectors and multi-yoke heads, according to one or more embodiments.

FIG. 8 depicts a schematic of an illustrative mooring support structure 100 having multi-yoke head connectors 880, 881 and multi-yoke heads 815, 816, according to one or more embodiments. The multi-yoke head mooring system 810 can include two or more yoke heads (two are shown) 815, 816 on the yoke 210 and two or more complimentary connectors, yoke head connectors (two are shown) 880, 881, connected to a yoke head connector frame 820. The yoke heads 815, 816 and the yoke head connectors 881, 881 can be similar in design and function to the yoke head 160 and 680, respectively in FIG. 2, FIG. 3, and FIG. 6, and the yoke head connector 215, respectively, in FIG. 2, FIG. 3, and FIG. 6. For example, apertures 872, 873 can be formed in yoke head connectors 880, 881 such that the yoke head connectors 880, 881 can slide over portions of the yoke heads 815, 816 for connection between the yoke head connectors 880, 881 and the yoke heads 815, 816. Likewise, the yoke heads 815, 816 and the yoke head connectors 881, 881 can also have any desired configuration with conical being one example.

As shown, the yoke head connectors 880, 881 can be angled yoke head connectors, with reference to FIG. 6 and FIG. 7, and the yoke heads 815, 816 can be configured at a complimentary angle to connect with the yoke head connectors 880, 881. Referring again to FIG. 8, the yoke 210 can include two or more legs 411, 412 that are connected to the ballast tank 230 at one end and a cross member 818 at the other end. In certain embodiments, the legs 411, 412, the ballast tank 230, and the cross-member 818 together can form a trapezoidal shape in plan view, or any shape, and can support the two or more yoke heads 815, 816. The trapezoidal shape can control side-to-side movement of the ballast tank 230 without the need for spring lines, with reference to FIG. 2 and as further explained below with reference to FIG. 9

Referring again to FIG. 8, the yoke head connector frame 820 can be connected to the turntable 130 and can support the two or more yoke head connectors 880, 881. One or more support members 150 can be connected to and can support the yoke head connector frame 820 and can be configured or adapted to keep the yoke head connector frame 820 at a particular angle with respect to the column 120 or to change the angle. The yoke head connector frame 820 can have three or more legs 821, 822, 823 (three are shown) arranged in a "V" shape in plan view, as shown, or any shape, to support the two or more yoke head connectors 880, 881. The yoke head connectors 880, 881 can be connected to the yoke head connector frame 820. In other embodiments, each yoke head connector 880, 881 can be connected to separate posts, similar to post 145 with reference to FIG. 4 and FIG. 7, and each post can be connected to the turntable 130 and independently supported by one or more support members 150.

Figure 9:
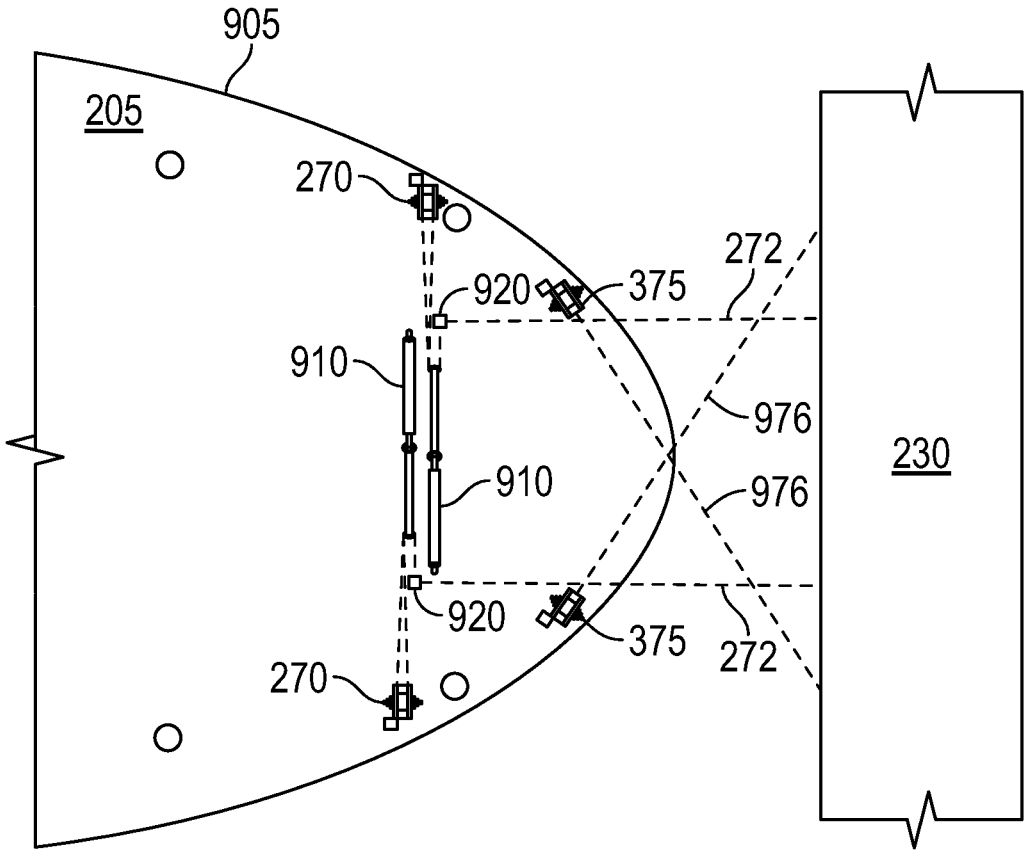
FIG. 9 depicts a schematic plan view of the bow of the vessel shown in FIG. 2 that depicts an illustrative arrangement of a plurality of winches that can be used to control movement of the ballast tank, according to one or more embodiments.

FIG. 9 depicts a schematic plan view of the bow of the vessel shown in FIG. 2 that depicts an illustrative arrangement for a plurality of winches that can be used to control movement of the ballast tank 230, according to one or more embodiments. For example, the spring line winch system 375 can be used in combination with the ballast tank pull-back winch system 270 for controlling movement of the ballast tank 230 using two or more elongated supports or two or more third elongated supports (spring lines) 976. The third elongated supports 976 can be wires, ropes, cables, chains, or the like, as well as any combinations of the same or the like. In particular, the ballast tank pull-back winch system 270 can be used to primarily control the forward and back movement of the ballast tank 230 (e.g. to and from the vessel structure 905), while the spring line winch system 375 can be used to primarily control the side-to-side movement of the ballast tank 230. Similar to the other winch systems 270, 380, the spring line winch system 375 can be or can include a dedicated hydraulic power unit and any combination of one or more winches, controls, compensating cylinders, accumulators, and coolers to provide rapid and reliable response times. Two horizontal cylinders 910 and sheaves 920 are shown and configured to work in tandem or in series with the pull-back winches 270 and the spring line winches 375 for controlling movement of the ballast tank 230.

Figure 10:
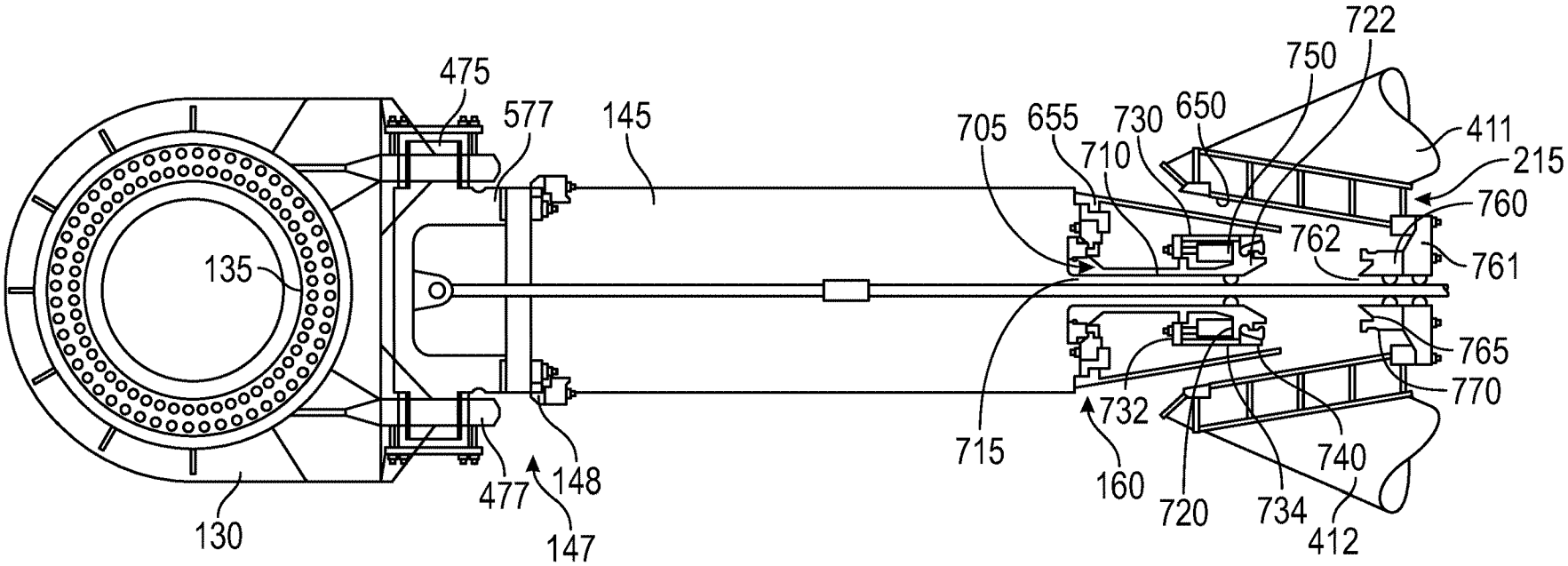
FIG. 10 depicts a partial cross section view of the working internals of an illustrative version of a yoke head and a yoke head connector prior to connection, according to one or more embodiments.

FIG. 10 depicts a partial cross section view of the working internals of an illustrative version of a yoke head 215 and a yoke head connector 160 prior to connection, according to one or more embodiments. The yoke head 215 and the yoke head connector 160 form a disconnectable yoke head assembly. A suitable disconnectable yoke head assembly can include the yoke head assembly disclosed in U.S. Pat. No. 9,650,110. The yoke head connector 160 can be arranged and designed to cooperate with the yoke head 215. Both the yoke head 215 and the yoke head connector 160 can have conical or frusto-conical shaped surfaces: an inner surface 650 of the yoke head 215 (female) and an outer surface 655 of the yoke head connector 160 (male).

Figure 11:
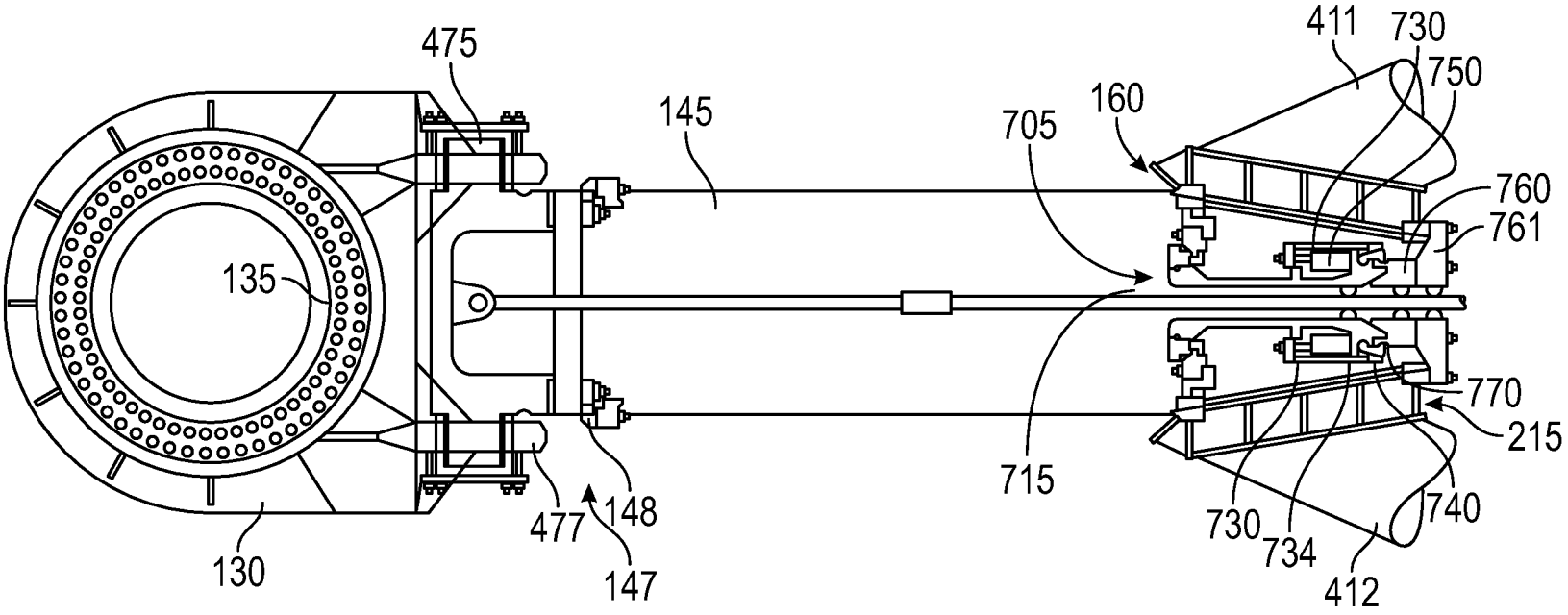
FIG. 11 depicts the partial cross section view of the working internals shown in FIG. 10 after connection, according to one or more embodiments.

FIG. 11 depicts the partial cross section view of the working internal shown in FIG. 10 after connection, according to one or more embodiments. Referring to FIGS. 10 and 11, a hydraulic and/or pneumatic connection assembly 705 can be mounted or otherwise disposed within the yoke head connector 160. The hydraulic connection assembly 705 can include a housing 710 having a bore 715 formed therethrough. The housing 710 can have an outwardly facing shoulder 720 and an extension or projection 722 formed thereon. One or more spaced apart fingers or collet segments 740 can be disposed about the housing 710 between the shoulder 720 and the projection 722. The outwardly facing shoulder 720 can be adjacent to and in contact with the fingers 740.

A movable sleeve 730 can be disposed about the housing 710. The movable sleeve 730 can have an inwardly directed flange 732 at one end and a band 734 at an opposite end. The band 734 can be adjacent to and configured to contact the one or more fingers 740. Linear movement of the sleeve 730 in a first direction (toward the vessel 205) allows the fingers 740 to rotate or pivot to a closed or locked position and linear movement of the sleeve 730 in an opposite, second direction (toward the tower 200) allows the fingers 740 to rotate or pivot about the outer surface of the housing 710 to an open or unlocked position.

One or more hydraulic and/or pneumatic cylinders or actuators 750 can used to move the sleeve 730 about the outer surface of the housing 710, allowing the fingers 740 to rotate or pivot open and close. The one or more actuators 750 can be positioned between and connected to the inwardly directed flange 732 of the movable sleeve 730 and the outwardly facing shoulder 720 of the stationary housing 710. When more than one actuator 750 is used, the actuators 750 can be controlled by a singular control to provide simultaneous operation and movement of the sleeve 730. The actuators 750 can be actuated from the mooring support structure 100 by accumulators and telemetry-controlled valves. Accumulators and telemetry-controlled valves are known to those skilled in the art.

Still referring to FIGS. 10 and 11, the yoke head 215 can include a mating hub 760 for receiving and connecting to the hydraulic connection assembly 705 of the yoke head connector 160. An annular adapter or member 761 can be disposed on the yoke head 215 and can be used to mount the mating hub 760. The mating hub 760 also can be an annular member having a bore 762 formed therethrough. The mating hub 760 can include a recessed section or receptacle 765 that can be sized and shaped to receive the projection 722 on the assembly housing 710. The mating hub 760 can also include a notched or profiled outer surface 770. The profiled outer surface 770 can be configured to engage and hold a similarly contoured profile that can be disposed on the fingers 740 such that when the fingers 740 rotate or pivot to their locked or closed position, the shaped profiles located on the fingers 740 and the outer surface 770 of the mating hub 760 matingly engage one other, as depicted in FIG. 8.

Referring to FIG. 10, as depicted the actuators 750 have moved the moveable sleeve 730 in the first direction toward the vessel 205, pushing the fingers 740 to rotate or pivot inwardly (toward the outer surface of the housing 710), such that the fingers 740 on the connector 270 engage the recessed profile 770 of the mating hub 760. In this closed position, the fingers 740 are generally parallel to the bore 715 of the housing 710 and overlap the profiled outer surface 770 on the mating hub 760, forming a lock and key engagement therebetween. Also, in this closed position, the projection 722 on the housing 710 can be located within the receptacle 765 of the mating hub 760. As such, the yoke head connector 160 can be fully engaged with the yoke head 215 and the vessel 205 can be securely moored to the mooring support structure 100. While engaged, the yoke head 215 cannot move or rotate independent of the yoke head connector 160.

It should be readily appreciated by those skilled in the art that the hydraulic connection assembly 705 and the mating hub 760, as provided herein, permit a quick disconnect under load and can be performed at sea, under harsh conditions. It should also be readily appreciated that the working internals and surfaces of the yoke head 215 and the yoke head connector 160 can be switch One process for disconnecting a moored vessel from a tower structure at sea can include: optionally orienting the disconnection location between the yoke head and the yoke head connector such that when the yoke head is separated from the yoke head connector, the yoke head can fall by gravity from the yoke head connector without contacting the mooring support structure; optionally applying stern thrust to the vessel, away from the mooring support structure; releasing the yoke head from the yoke head connector, where the yoke head is connected to a yoke, the yoke is connect to the ballast tank, and the ballast tank is connected, via one or more extension arms, to a vessel support structure disposed on the vessel; optionally controlling vertical movement of the yoke using a yoke lift and cushion system or a cushion cylinder located on or secured to the vessel support structure; and optionally controlling the back and forth movement (or horizontal movement) of the ballast tank using a first winch system located on the vessel.

Another process for disconnecting a moored vessel from a tower structure at sea can include: orienting a disconnection location between a yoke head and a yoke head connector connected to a mooring support structure such that when the yoke head is separated from the yoke head connector, the yoke head falls by gravity from the yoke head connector without contacting the mooring support structure, where: the yoke head is connected to a yoke, the yoke is connected to a ballast tank, and the ballast tank is connected to the vessel; and the floating vessel includes: a vessel support structure disposed on the vessel, one or more extension arms suspended from the vessel support structure; the ballast tank connected to the one or more extension arms, the ballast tank configured to or adapted to move back and forth below the support structure, a yoke lift and cushion system or a cushion cylinder located on the support structure, the yoke lift and cushion system or cushion cylinder connected to the yoke proximate the distal end of the yoke via one or more first elongated supports, and a ballast tank pull-back winch system connected to the ballast tank via one or more second elongated supports; releasing the yoke head from the yoke head connector; optionally applying stern thrust to the vessel, away from the tower structure; controlling vertical movement of the yoke using the cushion cylinder; and controlling the back and forth movement (or horizontal movement) of the ballast tank using the ballast tank pull-back winch system; optionally controlling the side-to-side movement of the ballast tank using a spring line winch system.

The present disclosure further relates to any one or more of the following numbered embodiments:

1. A mooring support structure, comprising: a base structure; a support column disposed on the base structure; a turntable disposed on the support column, wherein the turntable can at least partially rotate about the support column; an anchor location disposed above the turntable; a pitch bearing connected at a first end to the turntable; at least one post connected at a first end to a second end of the pitch bearing and extending out from the turntable; a support member extending from the anchor location and attached to the at least one post, wherein the support member is configured to rotate with the at least one post and the turntable; and a yoke head connector connected to a second end of the at least one post, wherein a distal end of the at least one yoke head connector provides a disconnection location such that when a yoke head is disconnected from the at least one yoke head connector, the yoke head is separated from the at least one yoke head connector without contacting the mooring support structure.

2. The mooring support structure of paragraph 1, wherein the yoke head falls by gravity from the at least one yoke head connector without contacting the mooring support structure.

3. The mooring support structure of paragraph 1 or 2, wherein the disconnection location is outside a perimeter of a deck located below the at least one post.

4. The mooring support structure of paragraph 1 to 3, wherein the support member can vary an angle at which the at least one post extends from the turntable.

5. The mooring support structure of paragraph 1 to 4, wherein a longitudinal centerline through the at least one yoke head connector is oriented at an angle not parallel to a longitudinal centerline of the at least one post, and wherein the longitudinal centerline extending from a distal end of the at least one yoke head connector is oriented in a downward direction.

6. The mooring support structure of paragraph 1 to 5, wherein the at least one yoke head connector is a conical coupler.

7. The mooring support structure of paragraph 1 to 6, wherein the at least one yoke head connector comprises a first yoke head connector and a second yoke head connector; wherein the at least one post comprises a first post and a second post; and wherein the first yoke head connector is connected to the first post and the second yoke head connector is connected to the second post.

8. A mooring support structure, comprising: a base structure; a support column disposed on the base structure; a turntable disposed on the support column, wherein the turntable can at least partially rotate about the support column; an anchor location disposed above the turntable; a yoke head connector frame connected at a first end to the turntable and extending out from the turntable; a support member extending from the anchor location and attached to the yoke head connector frame, wherein the support member is configured to rotate with the yoke head connector frame and the turntable; a first yoke head connector connected to a second end of the yoke head connector frame; and a second yoke head connector connected to the second end of the yoke head connector frame, wherein a distal end of the first and second yoke head connectors provides a disconnection location such that when a first and a second yoke head is disconnected from the first and second yoke head connectors, the first and second yoke heads fall by gravity from the first and second yoke head connectors without contacting the mooring support structure.

9. The mooring support structure of paragraph 8, wherein the disconnection location is outside a perimeter of a deck located below the post.

10. The mooring support structure of paragraph 8 or 9, wherein the support member can vary an angle at which the yoke head connector frame extends from the turntable.

11. The mooring support structure of paragraph 8 to 10, wherein a first longitudinal centerline through the first yoke head connector and a second longitudinal centerline through the second yoke head connector each extend from a distal end thereof in a downward direction.

12. The mooring support structure of paragraph 8 to 11, wherein the first and second yoke head connectors are conical couplers.

13. A mooring system, comprising: a mooring support structure comprising: a base structure; a support column disposed on the base structure; a turntable disposed on the support column, wherein the turntable is configured to at least partially rotate about the support column; an anchor location disposed above the turntable; a post connected at a first end to the turntable and extending out from the turntable; a support member extending from the anchor location and attached to the post, wherein the support member is configured to rotate with the post and the turntable; and a yoke head connector connected to a second end of the post; a vessel support structure disposed on a vessel; at least one extension arm suspended from the vessel support structure; a ballast tank connected to the at least one extension arm, the ballast tank configured to move back and forth below the vessel support structure; a yoke extending from and connected at a first end to the ballast tank, wherein the yoke comprises a yoke head disposed on a second end thereof, wherein the yoke head is disconnectedly engageable with the yoke head connector; and at least one cushion cylinder comprising one or more elongated supports, wherein the at least one cushion cylinder is disposed on the vessel support structure, and wherein the one or more elongated supports is routed through at least a portion of the at least one cushion cylinder and connected to the yoke to control a fall of the yoke during disconnection, wherein a distal end of the yoke head connector provides a disconnection location such that when the yoke head is disconnected from the yoke head connector, the yoke head falls by gravity from the yoke head connector without contacting the mooring support structure.

14. The system for mooring a vessel of paragraph 13, further comprising a buoyancy tank connected to the yoke proximate the second end thereof.

15. The system of paragraph 13 or 14, further comprising: a ballast tank pull-back winch system disposed on the vessel comprising one or more winch elongated supports wherein the one or more winch elongated supports is connected to the ballast tank to control a back and forth movement of the ballast tank.

16. A yoke mooring system, comprising: a vessel support structure disposed on a vessel; at least one extension arm suspended from the vessel support structure; a ballast tank connected to the at least one extension arm, the ballast tank configured to move back and forth below the vessel support structure; a yoke extending from and connected at a first end to the ballast tank, wherein the yoke comprises a yoke head disposed on a second end thereof, wherein the yoke head is disconnectedly engageable with a yoke head connector; and at least one cushion cylinder comprising one or more first elongated supports, wherein the at least one cushion cylinder is disposed on the vessel support structure, and wherein the one or more first elongated supports is routed through at least a portion of the at least one cushion cylinder and connected to the yoke to control a fall of the yoke during disconnection.

17. The system for mooring a vessel of paragraph 16, further comprising a buoyancy tank connected to the yoke proximate the second end thereof.

18. The system of paragraph 16 or 17, further comprising a ballast tank pull-back winch system disposed on the vessel comprising one or more second elongated supports, wherein the one or more second elongated supports is connected to the ballast tank to control a back and forth movement of the ballast tank.

19. A process for disconnecting a floating vessel moored to a mooring support structure at sea, comprising: disconnecting a yoke head from a yoke head connector, wherein: the mooring support structure comprises: a base structure; a support column disposed on the base structure; a turntable disposed on the support column, wherein the turntable is configured to at least partially rotate about the support column; an anchor location disposed above the turntable; a post connected at a first end to the turntable and extending out from the turntable; a support member extending from the anchor location and attached to the post, wherein the support member is configured to rotate with the post and the turntable; and the yoke head connector connected to a second end of the post, wherein a distal end of the yoke head connector provides a disconnection location such that when the yoke head is disconnected from the yoke head connector, the yoke head is separated from the yoke head connector without contacting the mooring support structure; and controlling a vertical movement of a yoke using at least one cushion cylinder located on a vessel support structure disposed on a vessel, wherein the yoke head is connected to the yoke, the yoke is connected to a ballast tank, and the ballast tank is connected to the vessel via at least one extension arm.

20. The process of paragraph 19, further comprising applying stern thrust to the vessel, away from the mooring support structure when the yoke head is disconnected from the yoke head connector.

21. The process of paragraph 19 or 20, further comprising controlling a back and forth movement of a ballast tank with a ballast tank pull-back winch system, wherein: a portion of the vessel support structure is cantilevered over a side of the vessel; at least one extension arm is suspended from the vessel support structure; the ballast tank is connected to the at least one extension arm and the ballast tank pull-back winch system; and the yoke extends from and is connected to the ballast tank at a first end of the yoke and the yoke head is connected to the second end thereof.

22. The process of paragraph 19 to 21, wherein a buoyancy tank is connected to the yoke.

23. The process of paragraph 19 to 22, wherein the at least one cushion cylinder is secured to the vessel support structure.

24. The process of paragraph 19 to 23, wherein disconnecting the yoke head from the yoke head connector comprises releasing pressure in a hydraulic cylinder to disconnect a collet connection between the yoke head and the yoke head connector.

25. The process of paragraph 19 to 24, wherein the yoke head connector comprises a mating hub having a recess and a notched profile disposed on an outer surface thereof, the hub being an annular member having a bore formed therethrough.

26. A mooring system, comprising: a mooring support structure comprising: a base structure; a turntable disposed on the base structure, wherein the turntable is configured to at least partially rotate about the base structure; a post extending from and connected at a first end to the turntable and a second end extending out from the turntable, wherein the post comprises a yoke head connector disposed on a second end thereof; and a vessel support structure disposed on a vessel floating on a surface of a body of water; at least one extension arm suspended from the vessel support structure; a ballast tank connected to the at least one extension arm, the ballast tank configured to move back and forth below the vessel support structure; a yoke extending from and connected at a first end to the ballast tank, wherein the yoke comprises a yoke head disposed on a second end thereof, wherein the yoke head is disconnectedly engaged with the yoke head connector, wherein a length of the post is configured to provide a connection location between the yoke head and the yoke head connector such that when the yoke head is disconnected from the yoke head connector, the yoke head falls from the yoke head connector toward the surface of the body of water without contacting the mooring support structure; and a first elongated support connected at a first end to the vessel support structure and connected at a second end to the yoke, wherein the elongated support is configured to support the yoke when the yoke head is disconnected from the yoke head connector.

27. The system of paragraph 26, further comprising an anchor location disposed on the mooring support structure above the turntable and configured to rotate with the turntable and a support member connected at a first end to the anchor location and connected at a second end to the post, wherein the support member is configured to support the post when the yoke is disconnected from the yoke head connector.

28. The system of paragraph 26 or 27, further comprising a hydraulic cylinder configured to support the post when the yoke head is disconnected from the yoke head connector.

29. The system of any of paragraphs 26 to 28, further comprising a cushion cylinder disposed on the vessel, wherein the first elongated support is routed around at least a portion of the cushion cylinder, and wherein the cushion cylinder is configured to reduce a tension load on the elongated support when the yoke head falls from the yoke head connector toward the surface of the body of water.

30. The system of any of paragraphs 26 to 29, further comprising a cushion cylinder disposed on the vessel, wherein the first elongated support is routed around at least a portion of the cushion cylinder, and wherein the cushion cylinder is configured to slow the fall of the yoke head toward the surface of the body of water by applying a tension to the yoke via the first elongated support.

31. The system of any of paragraphs 26 to 30, further comprising a ballast tank pull-back winch system disposed on the vessel comprising a second elongated support, wherein the second elongated support is connected to the ballast tank and configured to apply a tension on the ballast tank in a direction toward the vessel.

32. The system of any of paragraphs 26 to 31, wherein a longitudinal centerline through the yoke head connector is oriented at an angle not colinear with a longitudinal centerline of the post, and wherein the longitudinal centerline extending from a distal end of the yoke head connector is oriented in a downward direction.

33. The system of any of paragraphs 26 to 32, further comprising a spring line winch system disposed on the vessel comprising at least two third elongated supports, wherein a first end of each third elongated support is connected to the vessel and a second end of each third elongated support is connected to the ballast tank, and wherein the spring line winch system is configured dampen side to side movement of the ballast tank.

34. The system of any of paragraphs 26 to 33, wherein the post comprises a first post and a second post, wherein the yoke head connector comprises a first yoke head connector and a second yoke head connector disposed on the second end of the first and second posts, respectively, wherein the yoke comprises a first yoke head and a second yoke head each disconnectedly engageable with the first and second yoke head connectors, respectively.

35. The system of any of paragraphs 26 to 34, further comprising a cushion cylinder disposed on the vessel; a ballast tank pull-back winch system disposed on the vessel; and a spring line winch system disposed on the vessel, wherein: the first elongated support is routed around at least a portion of the cushion cylinder, and wherein the cushion cylinder is configured to slow the fall of the yoke head toward the surface of the body of water by applying a tension to the yoke via the first elongated support, the ballast tank pull-back winch system comprises a second elongated support, wherein the second elongated support is connected to the ballast tank and configured to apply a tension on the ballast tank in a direction toward the vessel, and the spring line winch system comprises at least two third elongated supports, wherein a first end of each third elongated support is connected to the vessel and a second end of each third elongated support is connected to the ballast tank, and wherein the spring line winch system is configured dampen side to side movement of the ballast tank.

36. The system of any of paragraphs 26 to 35, further comprising a buoyancy tank connected to the yoke proximate the second end thereof.

37. The system of any of paragraphs 26 to 36, wherein the yoke head connector or the first yoke head connector and a second yoke head connector each comprise a conical or frusto-conical coupler.

38. The system of any of paragraphs 26 to 37, wherein a length of the first elongated support is configured to permit the yoke to fall a predetermined distance when the yoke head is disconnected from the yoke head connector.

39. The system of paragraph 38, wherein the predetermined distance is selected such that the yoke head does not contact the surface of the body of water.

40. The system of paragraph 38 or 39, wherein the predetermined distance is 20 meters or less, 10 meters or less, 3 meters or less, or 2 meters or less.

41. The system of any of paragraphs 26 to 40, wherein a length of the post is adjustable such that during connection and/or disconnection of the yoke head and the yoke head connector the connection location can be at a first location and after connection and/or disconnection of the yoke head and the yoke head connector the connection location can be at a second location, wherein the second location is closer to the mooring support structure than the first location.

42. A process for disconnecting a vessel floating on a surface of a body of water moored to a mooring support structure, comprising: disconnecting a yoke head from a yoke head connector, wherein: the mooring support structure comprises: a base structure, a turntable disposed on the base structure, wherein the turntable at least partially rotates about the base structure, and a post extending from and connected at a first end to the turntable and a second end extending out from the turntable, wherein the post comprises the yoke head connector disposed on a second end thereof, the vessel comprises: a vessel support structure disposed on the vessel, at least one extension arm suspended from the vessel support structure, a ballast tank connected to the at least one extension arm, the ballast tank configured to move back and forth below the vessel support structure, a yoke extending from and connected at a first end to the ballast tank, wherein the yoke comprises the yoke head disposed on a second end thereof, and a first elongated support connected at a first end to the vessel support structure and connected at a second end to the yoke; and a length of the post provides a connection location between the yoke head and the yoke head connector such that when the yoke head is disconnected from the yoke head connector, the yoke head falls from the yoke head connector toward the surface of the body of water without contacting the mooring support structure; and maneuvering the vessel away from the mooring support structure.

43. The process of paragraph 42, further comprising, supporting the yoke with the first elongated support as the yoke head falls toward the surface of the body of water.

44. The process of paragraph 42 or 43, wherein: a cushion cylinder is disposed on the vessel, the first elongated support is routed around at least a portion of the cushion cylinder, and the cushion cylinder slows the fall of the yoke head toward the surface of the body of water by applying a tension to the yoke via the first elongated member.

45. The process of any of paragraphs 42 to 44, further comprising preventing the ballast tank from moving away from the vessel by pulling the ballast tank toward the vessel with a ballast tank pull-back winch system, wherein the ballast tank is connected to the ballast tank pull-back winch system via a second elongated support.

46. The process of any of paragraphs 42 to 45, wherein a thrust is not applied to urge the vessel away from the mooring support structure during the step of disconnecting the yoke head from the yoke head connector.

47. The process of any of paragraphs 42 to 46, wherein a thrust is applied to urge the vessel away from the mooring support structure during the step of disconnecting the yoke head from the yoke head connector.

48. The process of any of paragraphs 42 to 47, wherein a buoyancy tank is connected to the yoke proximate the second end thereof.

49. The process of any of paragraphs 42 to 48, wherein the mooring support structure comprises an anchor location disposed on the mooring support structure above the turntable that is configured to rotate with the turntable, wherein a support member is connected at a first end to the anchor location and connected at a second end to the post, and wherein the support member supports the post when the yoke head is disconnected from the yoke head connector.

50. The process of any of paragraphs 42 to 49, wherein disconnecting the yoke head from the yoke head connector comprises actuating an actuator in communication with the yoke head or the yoke head connector to unlock the yoke head and the yoke head connector from mating engagement with one another.

51. The process of any of paragraphs 42 to 50, further comprising dampening side to side movement of the ballast tank with a spring line winch system, wherein the spring line winch system is disposed on the vessel and comprises at least two third elongated supports, wherein a first end of each third elongated support is connected to the vessel and a second end of each third elongated support is connected to the ballast tank.

52. The process of any of paragraphs 42 to 51, further comprising supporting the post with a support member when the yoke head is disconnected from the yoke head connector.

53. The process of any of paragraphs 42 to 52, further comprising supporting the post with a hydraulic cylinder when the yoke head is disconnected from the yoke head connector.

54. The process of any of paragraphs 42 to 53, wherein a length of the first elongated support permits the yoke to fall a predetermined distance when the yoke head is disconnected from the yoke head connector.

55. The process of paragraph 54, wherein the predetermined distance is selected such that the yoke head does not contact the surface of the body of water.

56. The process of paragraph 54 or 55, wherein the predetermined distance is 20 meters or less, 10 meters or less, 3 meters or less, or 2 meters or less.

57. The process of any of paragraphs 42 to 56, wherein a length of the post is adjustable such that during connection and/or disconnection of the yoke head and the yoke head connector the connection location can be at a first location and after connection and/or disconnection of the yoke head and the yoke head connector the connection location can be at a second location, wherein the second location is closer to the mooring support structure than the first location.

58. The process of paragraph 57, further comprising extending the post to move the connection location from the second location to the first location prior to disconnecting the yoke head from the yoke head connector.

59. The process of paragraph 58, further comprising retracting the post to move the connection location from the first location to the second location.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim can be not defined above, it should be given the broadest definition persons in the pertinent art have given that term as reflected in at least one printed publication or issued patent. Furthermore, all patents, test procedures, and other documents cited in this application are fully incorporated by reference to the extent such disclosure can be not inconsistent with this application and for all jurisdictions in which such incorporation can be permitted.

While certain preferred embodiments of the present invention have been illustrated and described in detail above, it can be apparent that modifications and adaptations thereof will occur to those having ordinary skill in the art. It should be, therefore, expressly understood that such modifications and adaptations may be devised without departing from the basic scope thereof, and the scope thereof can be determined by the claims that follow.

What is claimed is:

1. A mooring system, comprising:

a mooring support structure comprising:

a base structure;

a turntable disposed on the base structure, wherein the turntable is configured to at least partially rotate about the base structure;

a post extending from and connected at a first end to the turntable and a second end extending out from the turntable, wherein the post comprises a yoke head connector disposed on a second end thereof; and a vessel support structure disposed on a vessel floating on a surface of a body of water;

at least one extension arm suspended from the vessel support structure;

a ballast tank connected to the at least one extension arm, the ballast tank configured to move back and forth below the vessel support structure;

a yoke extending from and connected at a first end to the ballast tank, wherein the yoke comprises a yoke head disposed on a second end thereof, wherein the yoke head is disconnectedly engaged with the yoke head connector, wherein a length of the post is configured to provide a connection location between the yoke head and the yoke head connector such that when the yoke head is disconnected from the yoke head connector, the yoke head falls from the yoke head connector toward the surface of the body of water without contacting the mooring support structure; and a first elongated support connected at a first end to the vessel support structure and connected at a second end to the yoke, wherein the elongated support is configured to support the yoke when the yoke head is disconnected from the yoke head connector.

2. The system of claim 1, further comprising an anchor location disposed on the mooring support structure above the turntable and configured to rotate with the turntable and a support member connected at a first end to the anchor location and connected at a second end to the post, wherein the support member is configured to support the post when the yoke head is disconnected from the yoke head connector.

3. The system of claim 1, further comprising a hydraulic cylinder configured to support the post when the yoke head is disconnected from the yoke head connector.

4. The system of claim 1, further comprising a cushion cylinder disposed on the vessel, wherein the first elongated support is routed around at least a portion of the cushion cylinder, and wherein the cushion cylinder is configured to reduce a tension load on the elongated support when the yoke head falls from the yoke head connector toward the surface of the body of water.

5. The system of claim 1, further comprising a cushion cylinder disposed on the vessel, wherein the first elongated support is routed around at least a portion of the cushion cylinder, and wherein the cushion cylinder is configured to slow the fall of the yoke head toward the surface of the body of water by applying a tension to the yoke via the first elongated support.

6. The system of claim 1, further comprising a ballast tank pull-back winch system disposed on the vessel comprising a second elongated support, wherein the second elongated support is connected to the ballast tank and configured to apply a tension on the ballast tank in a direction toward the vessel.

7. The system of claim 1, wherein a longitudinal centerline through the yoke head connector is oriented at an angle not colinear with a longitudinal centerline of the post, and wherein the longitudinal centerline extending from a distal end of the yoke head connector is oriented in a downward direction.

8. The system of claim 1, further comprising a spring line winch system disposed on the vessel comprising at least two third elongated supports, wherein a first end of each third elongated support is connected to the vessel and a second end of each third elongated support is connected to the ballast tank, and wherein the spring line winch system is configured dampen side to side movement of the ballast tank.

9. The system of claim 1, wherein the post comprises a first post and a second post, wherein the yoke head connector comprises a first yoke head connector and a second yoke head connector disposed on the second end of the first and second posts, respectively, wherein the yoke comprises a first yoke head and a second yoke head each disconnectedly engageable with the first and second yoke head connectors, respectively.

10. The system of claim 1, further comprising a cushion cylinder; a ballast tank pull-back winch system; and a spring line winch system each disposed on the vessel, wherein:

the first elongated support is routed around at least a portion of the cushion cylinder, and wherein the cushion cylinder is configured to slow the fall of the yoke head toward the surface of the body of water by applying a tension to the yoke via the first elongated support, the ballast tank pull-back winch system comprises a second elongated support, wherein the second elongated support is connected to the ballast tank and configured to apply a tension on the ballast tank in a direction toward the vessel, and the spring line winch system comprises at least two third elongated supports, wherein a first end of each third elongated support is connected to the vessel and a second end of each third elongated support is connected to the ballast tank, and wherein the spring line winch system is configured dampen side to side movement of the ballast tank.

11. The system of claim 1, further comprising a buoyancy tank connected to the yoke proximate the second end thereof.

12. The system of claim 1, further comprising a deck disposed on the base structure between the surface of the water and the turntable disposed on the base structure, wherein the connection location is located outside a perimeter of the deck.

13. The system of claim 1, wherein the turntable comprises a bearing configured to allow the turntable to at least partially rotate about the mooring support structure.

14. The system of claim 1, further comprising a deck disposed on the base structure above the turntable, wherein the deck is configured to at least partially rotate about the base structure with the turntable.

15. A process for disconnecting a vessel floating on a surface of a body of water moored to a mooring support structure, comprising:

disconnecting a yoke head from a yoke head connector, wherein:

the mooring support structure comprises:

a base structure, a turntable disposed on the base structure, wherein the turntable at least partially rotates about the base structure, and a post extending from and connected at a first end to the turntable and a second end extending out from the turntable, wherein the post comprises the yoke head connector disposed on a second end thereof, the vessel comprises:

a vessel support structure disposed on the vessel, at least one extension arm suspended from the vessel support structure, a ballast tank connected to the at least one extension arm, the ballast tank configured to move back and forth below the vessel support structure, a yoke extending from and connected at a first end to the ballast tank, wherein the yoke comprises the yoke head disposed on a second end thereof, and a first elongated support connected at a first end to the vessel support structure and connected at a second end to the yoke; and a length of the post provides a connection location between the yoke head and the yoke head connector such that when the yoke head is disconnected from the yoke head connector, the yoke head falls from the yoke head connector toward the surface of the body of water without contacting the mooring support structure; and maneuvering the vessel away from the mooring support structure.

16. The process of claim 15, further comprising, supporting the yoke with the first elongated support as the yoke head falls toward the surface of the body of water.

17. The process of claim 16, wherein:

a cushion cylinder is disposed on the vessel, the first elongated support is routed around at least a portion of the cushion cylinder, and the cushion cylinder slows the fall of the yoke head toward the surface of the body of water by applying a tension to the yoke via the first elongated member.

18. The process of claim 15, further comprising preventing the ballast tank from moving away from the vessel by pulling the ballast tank toward the vessel with a ballast tank pull-back winch system, wherein the ballast tank is connected to the ballast tank pull-back winch system via a second elongated support.

19. The process of claim 15, wherein a thrust is not applied to urge the vessel away from the mooring support structure during the step of disconnecting the yoke head from the yoke head connector.

20. The process of claim 15, wherein a thrust is applied to urge the vessel away from the mooring support structure during the step of disconnecting the yoke head from the yoke head connector.

21. The process of claim 15, wherein a buoyancy tank is connected to the yoke proximate the second end thereof.

22. The process of claim 15, wherein the mooring support structure comprises an anchor location disposed on the mooring support structure above the turntable that is configured to rotate with the turntable, wherein a support member is connected at a first end to the anchor location and connected at a second end to the post, and wherein the support member supports the post when the yoke head is disconnected from the yoke head connector.

23. The process of claim 15, wherein disconnecting the yoke head from the yoke head connector comprises actuating an actuator in communication with the yoke head or the yoke head connector to unlock the yoke head and the yoke head connector from mating engagement with one another.

* * * * *